US008230928B2

(12) United States Patent
Cuiper et al.

(10) Patent No.: US 8,230,928 B2
(45) Date of Patent: Jul. 31, 2012

(54) LOW PROFILE INTERNAL TREE CAP

(75) Inventors: Glen H. Cuiper, Spring, TX (US); Paulo Cezar Silva Paulo, Katy, TX (US); André Smith, Lier (NO)

(73) Assignee: Aker Subsea Inc., Houston, TX (US)

( * ) Notice: Subject to any disclaimer, the term of this patent is extended or adjusted under 35 U.S.C. 154(b) by 531 days.

(21) Appl. No.: 12/427,566

(22) Filed: Apr. 21, 2009

(65) Prior Publication Data

US 2009/0266551 A1 Oct. 29, 2009

Related U.S. Application Data

(60) Provisional application No. 61/093,799, filed on Sep. 3, 2008, provisional application No. 61/047,342, filed on Apr. 23, 2008.

(51) Int. Cl.
*E21B 23/00* (2006.01)

(52) U.S. Cl. ..... 166/338; 166/351; 166/368; 166/75.13; 138/89

(58) Field of Classification Search ..... 166/338, 166/339, 341, 348, 351, 368, 381, 93.1, 94.1, 166/95.1, 97.1, 75.13; 138/89
See application file for complete search history.

(56) References Cited

U.S. PATENT DOCUMENTS 4,453,599 A * 6/1984 Fredd ..... 166/374
4,751,965 A * 6/1988 Cassity ..... 166/182
4,911,244 A * 3/1990 Hynes ..... 166/368
5,163,514 A * 11/1992 Jennings ..... 166/368
5,450,905 A * 9/1995 Brammer et al. ..... 166/348
5,755,290 A * 5/1998 Crichton ..... 166/379
5,868,204 A * 2/1999 Pritchett et al. ..... 166/368
5,875,851 A * 3/1999 Vick et al. ..... 166/386
5,884,706 A * 3/1999 Edwards ..... 166/335
5,988,277 A * 11/1999 Vick et al. ..... 166/123
5,988,282 A * 11/1999 Jennings et al. ..... 166/348
5,992,526 A * 11/1999 Cunningham et al. ..... 166/343
5,996,697 A * 12/1999 Vick et al. ..... 166/386
6,076,605 A * 6/2000 Lilley et al. ..... 166/368
6,474,416 B2 * 11/2002 Beall et al. ..... 166/343
6,494,257 B2 * 12/2002 Bartlett et al. ..... 166/86.2
6,655,455 B2 * 12/2003 Bartlett et al. ..... 166/86.2
(Continued)

OTHER PUBLICATIONS

Search Report and Written Opinion dated Jun. 12, 2009 issued in corresponding application No. PCT/ US2009/041413.

*Primary Examiner* — Thomas Beach
*Assistant Examiner* — Matthew Buck
(74) *Attorney, Agent, or Firm* — Parsons Behle & Latimer

(57) ABSTRACT

An internal tree cap having a running configuration and a latched configuration to be selectively secured to a tree spool. The tree cap may include an inner sleeve movable between upper and lower positions. The movement of the inner sleeve to the lower position may simultaneously engage a locking profile within the tree spool and energize a sealing element around the exterior of the tree cap. The tree cap may be a low profile tree cap that is flush with the top of the tree spool when installed. The tree cap may provide a collateral beneficial locking means to secure a tubing hanger within the tree spool. A lower housing may be attached to the tree cap to seal on the exterior of the upper neck of the tubing hanger. The tree cap may include a profile to accept a wireline plug.

9 Claims, 27 Drawing Sheets

U.S. PATENT DOCUMENTS 6,681,850 B2 * 1/2004 Bartlett et al. ..... 166/86.2
6,763,891 B2 * 7/2004 Humphrey et al. ..... 166/368
6,776,230 B2 * 8/2004 Collie et al. ..... 166/97.1
6,810,954 B2 * 11/2004 Garrett et al. ..... 166/77.51
7,028,777 B2 * 4/2006 Wade et al. ..... 166/343
7,325,598 B2 * 2/2008 Bartlett ..... 166/75.13
7,490,673 B2 * 2/2009 Bartlett ..... 166/368
7,621,338 B2 * 11/2009 Wenham et al. ..... 166/343
7,654,329 B2 * 2/2010 Lindland et al. ..... 166/368
7,677,319 B2 * 3/2010 Baskett ..... 166/360
2004/0163818 A1 8/2004 Fenton et al.
2004/0262010 A1 12/2004 Milberger
2005/0034870 A1 2/2005 Buckle et al.
2005/0241821 A1 11/2005 Milberger

* cited by examiner

LOW PROFILE INTERNAL TREE CAP

The present disclosure claims priority to U.S. provisional patent application No. 61/093,799, entitled Low Profile Internal Tree Cap, filed Sep. 3, 2008; and also claim priority to U.S. provisional patent application No. 61/047,342, entitled Low Profile Internal Tree Cap, filed Apr. 23, 2008. The disclosures of both of these provisional patent applications are incorporated herein by reference in their entirety.

BACKGROUND

1. Field of the Disclosure

The present disclosure generally relates a low profile internal tree cap and a system and method for installing a low profile internal tree cap in a subsea wellhead. The low profile internal tree cap may include various fluid passageways to permit the removal of trapped fluid during the installation of the tree cap. The internal tree cap may include means for sealing on the outer diameter of the upper neck of the tubing hanger. Alternatively, the internal tree cap may include means for sealing in the upper plug seal profile of a tubing hanger or tubing hanger crossover. The internal tree cap may include bi-directional metal-to-metal seals allowing the tree cap to be used on a gas lift well.

2. Description of the Related Art

A subsea wellhead assembly often includes a tree spool used to access the well bore. A tree cap may be used to seal off the tree spool while also permitting access to the tree spool. The tree cap typically includes one or more seals that are disposed between the tree cap and the tree spool to provide a seal between the tree cap and the tree spool. While installing a tree cap in a subsea tree one potential problem is damaging the seals during the installation process. The seals are the key component to the tree cap so it is important to prevent damage to the seals during the installation process. One way to prevent potential damage to the seals is to land the tree cap on the tree spool, secure the tree cap in the tree spool, and then energize or set the seals between the secured tree cap and the tree spool. This series of steps may lengthen and complicate the installation process. Thus, it may be beneficial to hold the seals in a non-energized state and then simultaneously secure the tree cap to the tree spool and energize the sealing elements.

The installation of a tree cap on a subsea tree spool can be difficult. Thus, it may be beneficial to provide a tree cap that does not require a particular radial orientation to land in and secure to a tree spool. The tree cap may be selectively connected to a running tool and run to the tree spool through a marine riser. In different applications, a remotely operated vehicle ("ROV") may be used to run the tree cap to the tree spool and to remotely install the tree cap and set or energize the sealing elements. It may be beneficial to provide a tree cap that could be installed attached to a running tool ran through a marine riser or at open sea with an ROV.

An installed tree cap may project above the tree spool presenting a potential obstruction to other wellhead equipment. It may be beneficial to provide an internal tree cap having a low profile when secured to a tree spool. An installed tree cap on a tree spool creates a fluid barrier, which is beneficial to prevent the flow of fluid up the wellbore due to increases in well pressure. Increased well pressure may cause the undesired upward movement of well equipment, such as a tubing hanger, already installed in the tree spool. It would be beneficial to provide a tree cap that provides a collateral beneficial locking means for preventing undesired upward movement of well equipment due to pressure. Various configurations of tubing hangers may be employed within a tree spool. Thus, it may be beneficial to provide a tree cap that is modular enabling it to be connected to variously configured adapters to lock down differing tubing hangers.

Fluid may become trapped within the cavity of the tree cap while the tree cap is being installed onto a tree spool. This may be problematic for a light weight tree cap as the fluid may prevent the tree cap from properly landing on the tree spool. Further, the sea water may cause corrosion of some of the internal parts of the tree cap and subsea tree system such as the VX gasket. It would be beneficial to provide means for releasing trapped fluid from within the cavity of the tree cap. Further, it would be beneficial if this means also allowed for the injection of a corrosion inhibitor within the tree cap. Also a change in pressure within the wellbore may make it difficult to remove the tree cap from the tree spool. It would be beneficial to provide a flow path or other means that may be used to equalize the pressure above and below the tree cap to facilitate the removal of the tree cap from the tree spool.

A gas lift may be applied to a well in an effort to increase hydrocarbon production. Conventional tree caps may not be equipped to withstand fluid pressure within the annulus and the production bore. Thus, it may be beneficial to provide a tree cap that is equipped with bi-directional metal-to-metal seals to prevent undesired leakage of fluid through and/or around the tree cap.

In light of the foregoing, it would be desirable to provide a tree cap that may simultaneously be secured to a tree spool and energize or set a sealing element. It would also be beneficial to provide a tree cap that may be installed with a running tool through a marine riser or be installed remotely using an ROV. It would be beneficial to provide a tree cap that may be a collateral beneficial locking means for preventing upward movement of wellhead equipment, such as a tubing hanger, within a tree spool. It would be beneficial to provide the collateral beneficial locking means as a modular attachment permitting the later addition of the locking means to a tree cap. It would be beneficial to provide a tree cap that is flush with the top of the tree spool when landed and installed in the tree spool. It would be beneficial to provide a tree cap that permits the removal of water trapped between the tree cap and the subsea tree, permits the injection of fluid below the tree cap, and permits the equalization of pressure prior to the removal of the tree cap. It would also be beneficial to provide a tree cap that may be adapted to provide a seal within the tubing hanger.

The present disclosure is directed to overcoming, or at least reducing the effects of, one or more of the issues set forth above.

SUMMARY

One embodiment of the internal tree cap includes an inner housing that has a central opening running longitudinally through the inner housing. The upper end of the inner housing includes a latching profile for engagement with a running tool. The lower end of the inner housing is received in the cavity of a lower housing. The inner housing is movable with respect to the lower housing between a running or upper position and a lower or landed position. In the lower or landed position the bottom of the inner housing rests on the lower housing.

The internal tree cap includes an inner body that is positioned between a portion of the lower housing and the central opening of the lower end of the inner housing and also includes a split latch ring that is located between the upper end of the lower housing and a first exterior shoulder of the inner housing. The split latch ring is on the exterior of the internal tree cap and is movable between an inner position and an outer position. The split latch ring is initially in the inner position while the tree cap is run to the tree spool. During the movement of the inner housing to the lower or latched position the first exterior shoulder moves the split latch ring to its outer position. In the outer position, the split latch ring engages a locking profile in a tree spool securing the internal tree cap to the tree spool.

The internal tree cap further includes a support ring that is located above the split latch ring and is also positioned around the first exterior shoulder of the inner housing. The support ring supports a bulk seal located directly above the support ring and also being positioned around the first exterior shoulder of the inner housing. The downward movement of the inner housing to the lower or latched position energizes the bulk seal by moving it onto a larger diameter of the inner housing until it reaches a second exterior shoulder. The support ring along with the second exterior shoulder retains the energized bulk seal in position along the exterior surface of the inner housing. The bulk seals contacts a sealing surface in a tree spool providing a seal between the tree spool and the exterior of the internal tree cap.

The internal tree cap includes expansion plug located in the central opening of the inner housing that is movable between a lower position and an upper position. A spring is positioned between a shoulder of the expansion plug and the inner body is compressed when the expansion plug is in its lower position. Thus, the spring is biased to move the expansion plug to its upper position. During the initial running of the internal tree cap the expansion plug is selectively retained in the lower position by expansion pins extending through openings of a retainer ring that is positioned between the inner housing and the expansion plug. An expansion ring prevents the retraction of the expansion pins while the inner housing is in its upper or running position.

Upon movement of the inner housing to the landed or lower position, the expansion ring moves outward into a recess in the inner housing. This recess is located above the expansion ring while the inner housing is in the running position. The outward movement of the expansion ring permits the spring to push the expansion plug upwards causing the expansion pins to retract. The upward position of the expansion plug may retain the split latch ring in its outer position, which secures the internal tree cap to the tree spool. The retraction of the expansion pins is now permitted due to the outward expansion of the expansion ring. The downward movement of the inner housing also causes the first exterior shoulder of the inner housing to move the split latch ring to its outer position engaging a lock profile in the tree spool securing the internal tree cap to the tree spool. The downward movement also energizes the bulk seal sealing the exterior of the internal tree cap with a seal profile of the tree spool.

The internal tree cap may also include a flow passage through the tree cap. The flow passage may permit the equalization of pressure above and below the tree cap, the flushing of the tree cap, or the injection of an inhibitor below the tree cap. Upon installation of the internal tree cap onto a tree spool, the upper end of the inner body may be flush or be located below the upper end of the tree spool. The landed internal tree cap may also provide a collateral beneficial locking means for a tubing hanger already secured within the tree spool. The internal tree cap may also include a lower seal that seals against a portion of the tubing hanger. The lower seal may be a metal seal that forms a metal-to-metal seal with the tubing hanger. The internal tree cap may include a lower extension connected to the lower housing that forms a metal-to-metal seal with the tubing hanger. The internal tree cap may form a metal-to-metal seal with the tree spool in addition to the energized bulk seal. Alternatively, the bulk seal may be replaced with a metal-to-metal seal. The internal tree cap may further include a stinger connected to the lower housing of the tree cap. Upon landing in the tree spool, a sealing element on the stinger may create a seal within a sealing bore within the tubing hanger.

The internal tree cap may include a lower adapter that may be connected to the lower housing. The lower adapter may include at least one sealing element adapted to seal on the outer diameter of the upper neck of the tubing hanger. There sealing element may be comprised of hardened plastic or other material that is acceptable for subsea use and will minimize damage to the tubing hanger neck. The lower adapter permits the tree cap to be modular adapting the tree cap to be used in various applications. For example, a stinger may be connected to the lower adapter. The stinger may include a metal lip seal that upon installation of the tree cap on the tree spool the metal lip seal is positioned within the upper plug seal profile of the tubing hanger providing a seal between the stinger and the tubing hanger. The stinger may include two metal lip seals providing a bi-directional seal. The profile of the lower adapter may be configured to provide a collateral beneficial locking means to various configurations of tubing hangers.

Another embodiment is a method for installing an internal tree cap in a tree spool. The method includes latching a bore protector running tool into a locking profile of the internal tree cap. The locking profile is in an inner housing that is movable between a running position and a latched position. The method includes running the internal tree cap to a tree spool with the bore protector running tool connected to a drill string and landing the internal tree cap on top of a tubing hanger that is already connected to the tree spool. The method further includes dropping a device, such as a ball or a dart, down the drill string. The device lands on a movable piston of the bore protector running tool. The piston is movable upon pressure within the drill string. The method also includes increasing the pressure within the drill string and moving the inner housing of the internal tree cap from the running position to the latching position. The movement of the inner housing simultaneously latches the internal tree cap to a locking profile of the tree spool and energizes a bulk seal of the internal tree cap.

The method may further include releasing the running tool from the internal tree cap as the inner housing moves into the latching position. During the running step, the bore protector running tool and connected internal tree cap may be run through a marine riser to the tree spool. The method may further include equalizing pressure within the tree spool below the internal tree cap with the pressure above the internal tree cap through a flow circuit in the internal tree cap or injecting a fluid into the tree spool through a flow circuit in the internal tree cap.

Another embodiment is a method for installing an internal tree cap on a tree spool that includes moving the internal tree cap to a tree spool. The internal tree cap includes an inner housing that is movable between a running position and a latching position. The inner housing of the internal tree cap remains in the running position while the internal tree cap is moved to the tree spool. The method includes landing the internal tree cap on top of a tubing hanger connected to the tree spool and remotely actuating the inner housing of the internal tree cap to move from the running position to the latching position. The movement of the inner housing simultaneously latches the internal tree cap to a locking profile of the tree spool and energizes a bulk seal of the internal tree cap. The method may include using a ROV to move the internal tree cap to the tree spool.

Another embodiment of the present disclosure is directed to an internal tree cap. The tree cap can comprise an upper housing having an upper end, a lower end, and a central opening through the upper housing. The upper end can have a latching profile for engagement with a running tool. A lower housing can be adapted to receive the lower end of the upper housing. The upper housing can be movable with respect to the lower housing between a running position and a landed position. A set ring can be positioned around the lower housing, the set ring being movable between an upper position and a lower position. The set ring can be fixed to the upper housing in such a way that the set ring and upper housing move in sync with each other. An outer split latch ring can be positioned around an exterior of the internal tree cap. The outer split latch ring can be movable between a first inner position and a first outer position, wherein a downward movement of the set ring is capable of pushing the outer split latch ring outward to its outer position as the upper housing moves to the landed position. An inner split latch ring can be positioned between the upper housing and the lower housing. The inner split latch ring can be movable between a second outer position and a second inner position. The tree cap can also comprise a lock device positioned above the inner split latch ring when the inner split latch ring is in the second outer position. The lock device can be configured to push the inner split latch ring inward to the second inner position when the upper housing is in the latching position. The lock device can be capable of exerting inward pressure onto the inner split latch ring, thereby holding it in its inner position. A support ring can be positioned above the outer split latch ring about the exterior of the internal tree cap. A sealing means can be positioned so as to provide an effective seal between the lower housing and a tree spool when the internal tree cap is positioned in the tree spool.

Figure 1:
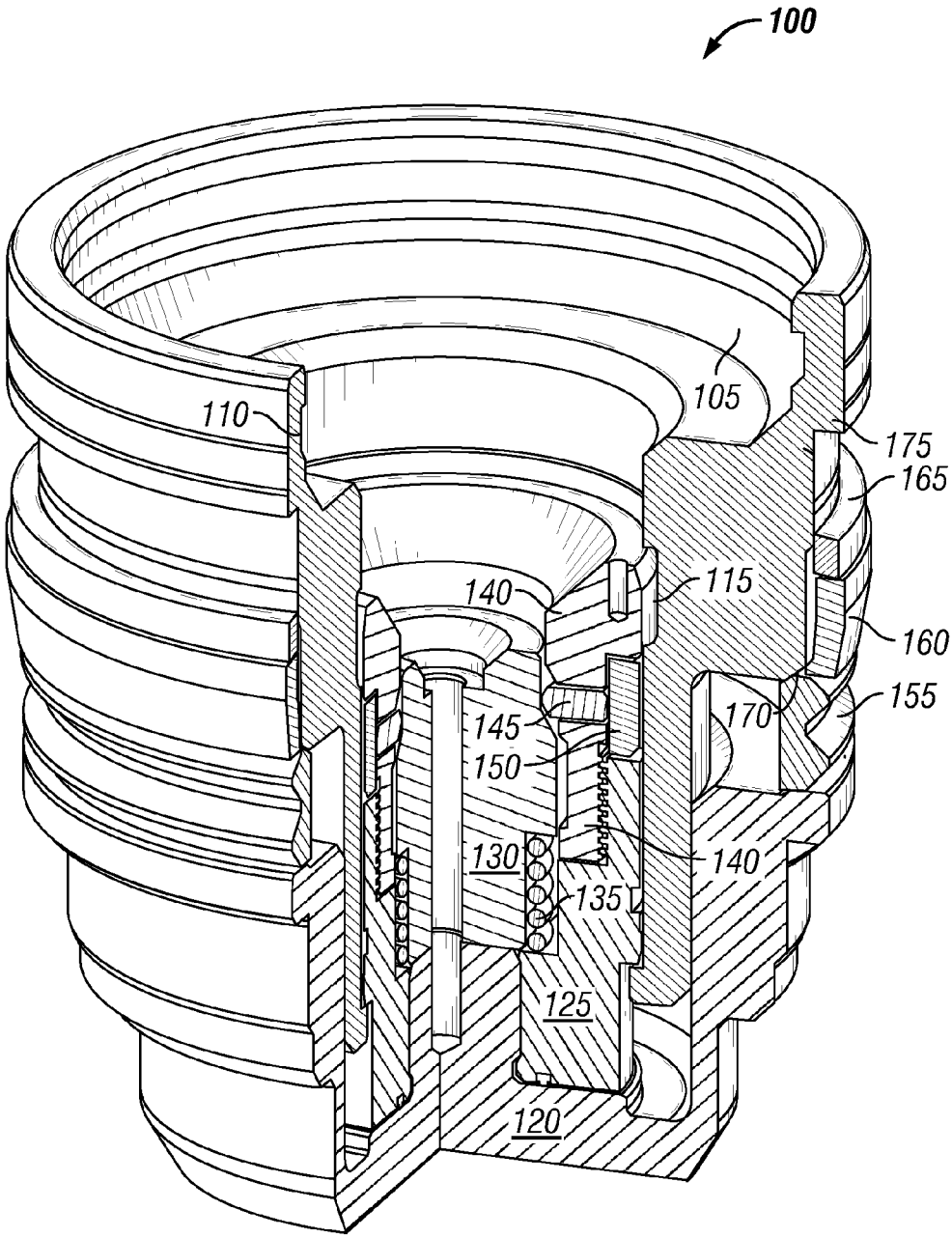
FIG. 1 shows a partial cutaway view of one embodiment of an internal tree cap in a running-in position.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the disclosure are described below as they might be employed in an internal tree cap. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the disclosure will become apparent from consideration of the following description and drawings.

Figure 2:
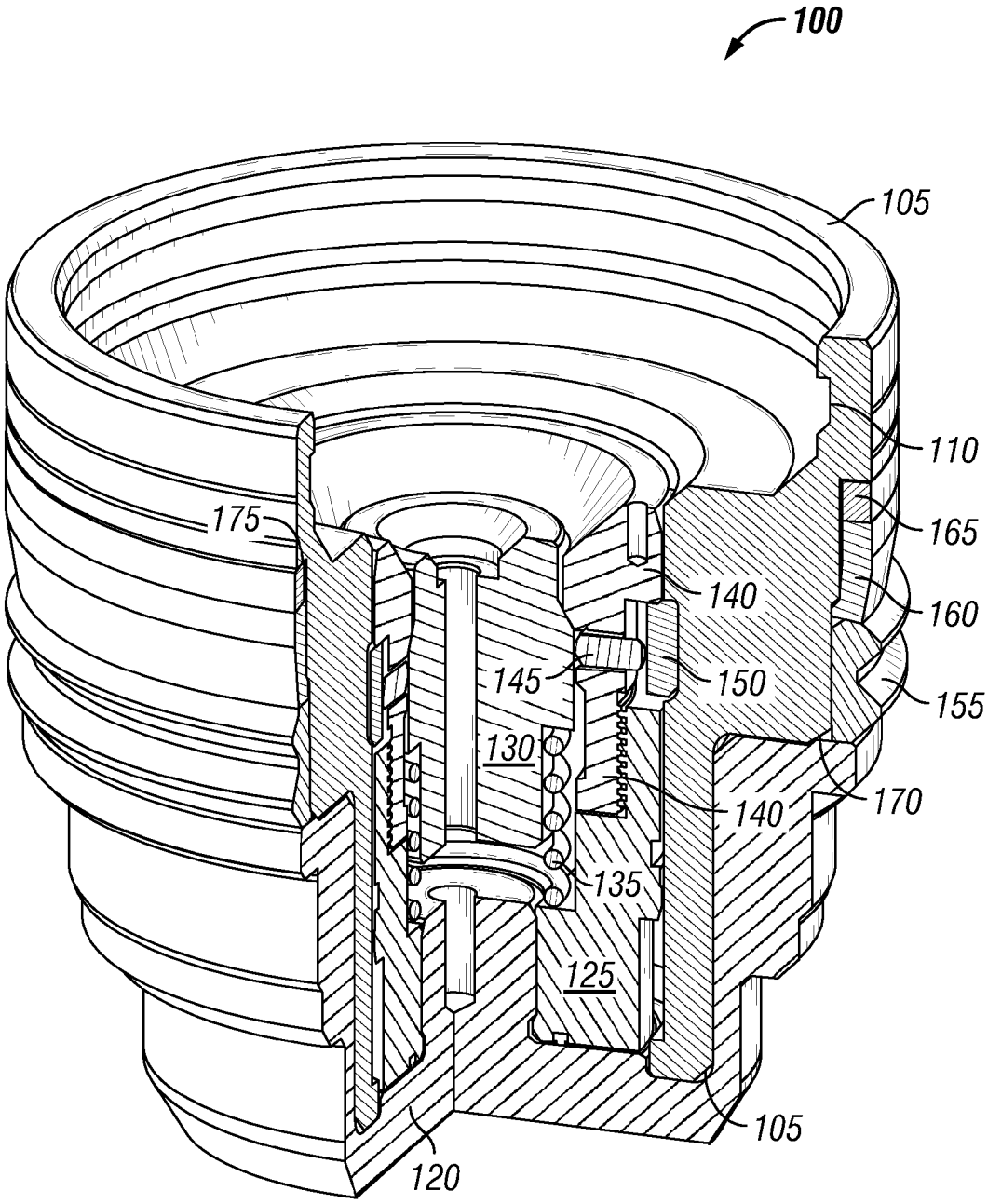
FIG. 2 shows a partial cutaway view of the low profile tree cap of FIG. 1 in a landed or latched position.

FIG. 1 shows one embodiment of an internal tree cap 100. The internal tree cap 100 includes an inner housing 105 and a lower housing 120. The inner housing 105 includes a locking profile 110 that may be adapted to engage a running tool 400 (shown in FIG. 7). One example of such as a running tool is a bore protector running tool. The locking profile 110 is shown for illustrative purposes only and may be adapted to engage various running or setting tools as would be appreciated by one of ordinary skill in the art having the benefit of this disclosure. The inner housing 105 includes a central bore running the length of the housing and also includes a first exterior shoulder 170 and a second exterior shoulder 175. The inner housing 105 is movable between an upper or running position, as shown in FIG. 1, and a lower or latched position, as shown in FIG. 2. The lower housing 120 is adapted to receive the lower end of the inner housing 105 when it is moved into its lower or landed position.

A split latch ring 155 is positioned around the exterior of the internal tree cap 100. The split latch ring 155 is movable between an inner position, as shown in FIG. 1, and an outer position, as shown in FIG. 2. While in the inner position, the first exterior shoulder 170 of the inner housing 105 rests on the split latch ring 155. The downward movement of the first exterior shoulder 170 as the inner housing 105 moves to the latching position pushes the split latch ring 155 outward to its outer position. A support ring 160 is positioned above the split latch ring 155 about the exterior of the internal tree cap 105. Above the support ring 160 is a bulk seal 165 that is energized by the downward movement of the inner housing 105 as discussed in more detail in regards to FIG. 2.

The internal tree cap 100 also includes an inner body 125 that is positioned between the inner housing 105 and a central projection from the bottom of the lower housing 120. A spring 135 may be compressed between a shoulder of the inner body 125 and a shoulder of an expansion plug 130. The expansion plug 130 is movable between a lower position, shown in FIG. 1, and an upper position, as shown in FIG. 2. The spring 135 is biased to move the expansion plug 130 to the upper position, but expansion pins 145 prevent the upward movement of the expansion plug 130 while the inner housing 105 is in its running position.

A retainer ring 140 is connected to the top portion of the inner body 125. The retainer ring 140 may be threaded to the inner body 125 or various other means may be used to connect together the two parts as would be appreciated by one of ordinary skill in the art having the benefit of this disclosure. The expansion pins 145 project inwards through openings 146 (shown in FIG. 6) in the retainer ring 140. An expansion ring 150 is positioned between the inner housing 105 and a recess between the inner body 125 and the retainer ring 140. The expansion ring 150 prevents the outward movement of the expansion pins 145 while the inner housing 105 is in its running position.

FIG. 2 shows the inner housing 105 moved into the latched or lower position. When the inner housing 105 is in the latched position a recess 115 (shown in FIG. 1) on the inner surface of the inner housing 105 aligns with the expansion ring 150 permitting the expansion ring 150 to move outwards or expand into the recess 115. The outward expansion of the expansion ring 150 permits the spring 135 to force the expansion plug 130 upwards. As the expansion plug 130 moves upwards, the larger outer diameter of the plug 130 pushes the expansion pins 145 outwards as expansion ring 150 no longer is positioned to hold the expansion pins 145 in their inward position. The expansion plug 130 in the upper position retains the split latch ring 155 in its outer position engaging a locking profile in the tree spool until a running tool depresses the expansion plug 130 to retrieve the internal tree cap 100.

As discussed above, the downward movement of the inner housing 105 forces the split latch ring 155 outwards as the first exterior shoulder 170 moves past the top of the split latch ring 155. The downward movement of the inner housing 105 also energizes the bulk seal 165 located on the exterior of the inner housing 105 as the upper adjacent portion of the inner housing 105 has a larger outer diameter than the diameter of the inner housing 105 at the initial position of the bulk seal 165. The support ring 160 and second exterior shoulder 175 help to ensure the bulk seal 165 is adequately energized and help to secure the energized bulk seal 165 in place.

Figure 3:
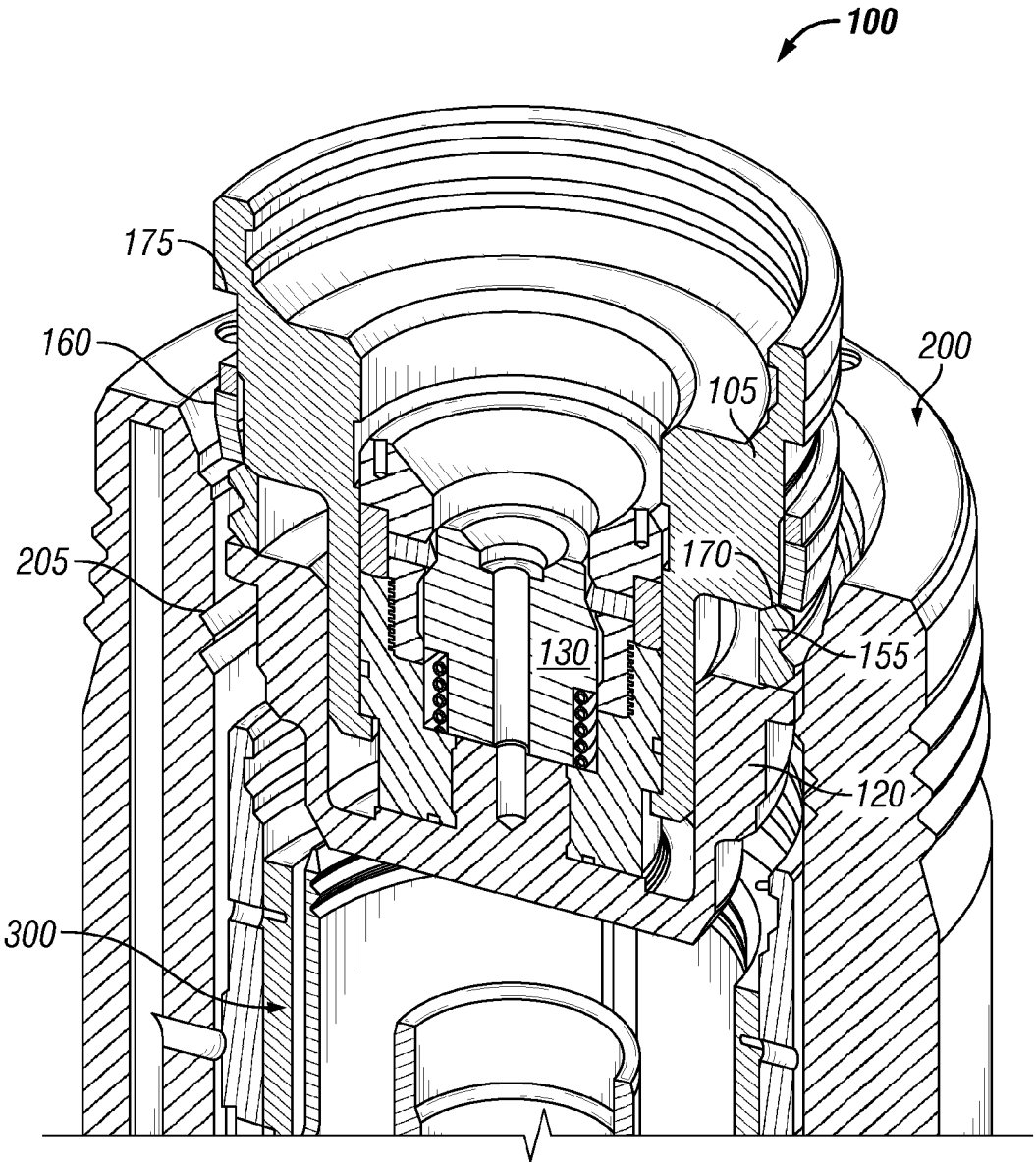
FIG. 3 shows a cross-section view of an internal tree cap prior to landing in a tree spool.
Figure 4:
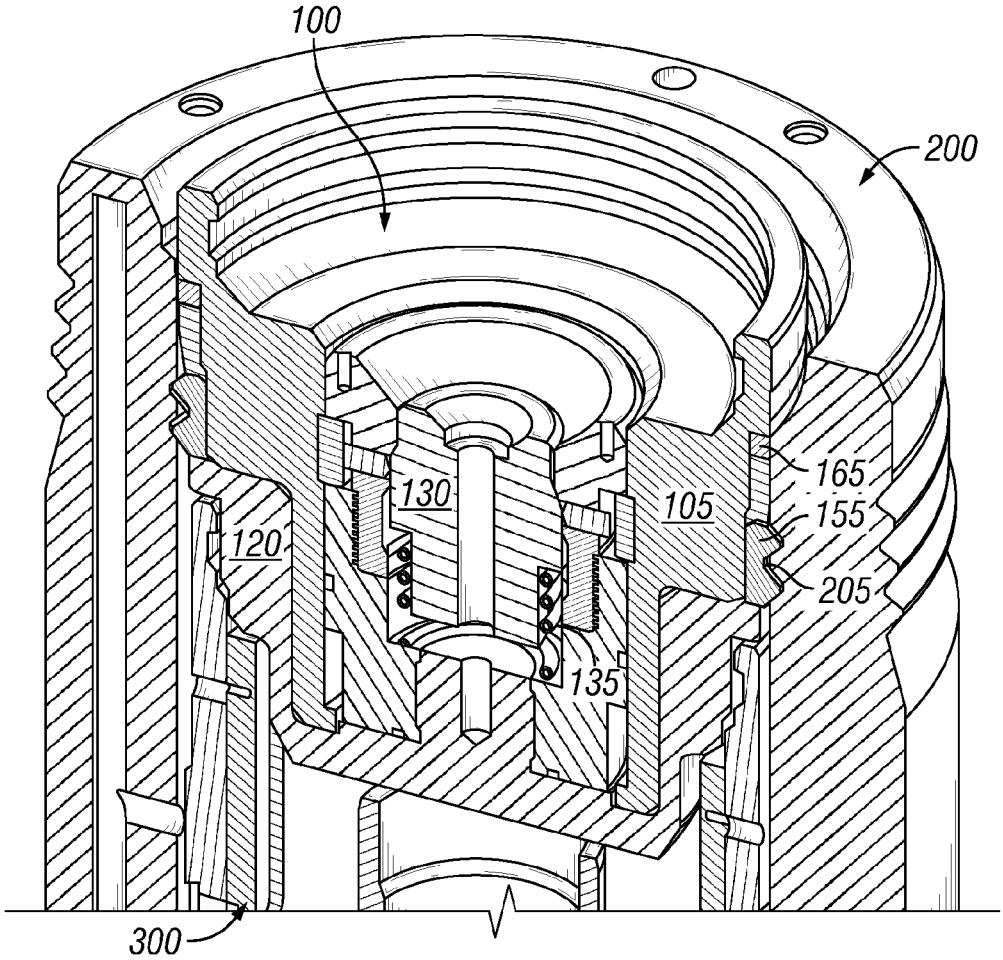
FIG. 4 shows a cross-section view of an internal tree cap latched in the locking profile of a tree spool.

FIG. 3 shows the internal tree cap 100 being lowered into a tree spool 200 with the inner sleeve 105 in the running or upper position. FIG. 4 shows the lower housing 120 of internal tree cap 100 landed on a tubing hanger 300 installed in the tree spool 200. The inner sleeve 105 has been shifted to the latching or lower position causing the outward movement of the split latch ring 155 to engage the locking profile 205 of the tree spool 200. The internal tree cap 100 secured to the tree spool 200 may provide a collateral beneficial locking means to prevent the upward movement of the tubing hanger 300 due to well pressure. The bulk seal 165 has been energized and provides a seal between the internal tree cap 100 and the tree spool 200.

Figure 5:
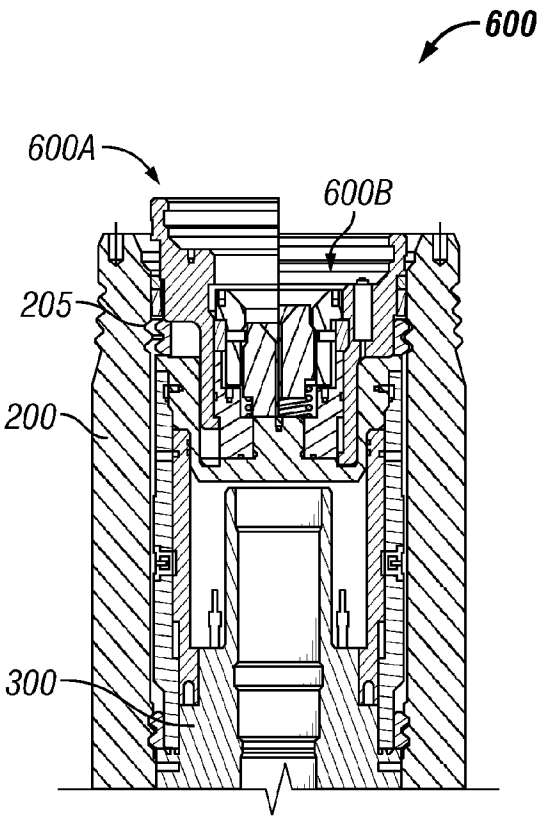
FIG. 5 shows a cross-section comparison view of one embodiment of an internal tree cap 600 with one half an internal tree cap 600A illustrated running into a tree spool and one half of an internal tree cap 600B illustrated as latched into the locking profile of the tree spool.

FIG. 5 shows a cross-section comparison view of one embodiment of an internal tree cap 600 with half of the internal tree cap 600A being run into a tree spool 200 next to another half of the internal tree cap 600B latched into the tree spool 200. The internal tree cap 600 may include a fluid passage that permits the flushing of the internal tree cap 100 or permits the injection of an inhibitor into the well below the internal tree cap 600. Further, the fluid passage may permit the equalization of pressures above and below the internal tree cap 600 prior to removal of the internal tree cap 600 from the tree spool 200. The top of the internal tree cap 600 may be flush with the top of the tree spool 200 when latched into place as shown by internal tree cap 600B in FIG. 5. This low profile of internal tree cap 600 may be beneficial in preventing accidents or collisions with other equipment while working or providing maintenance on the well.

Figure 6:
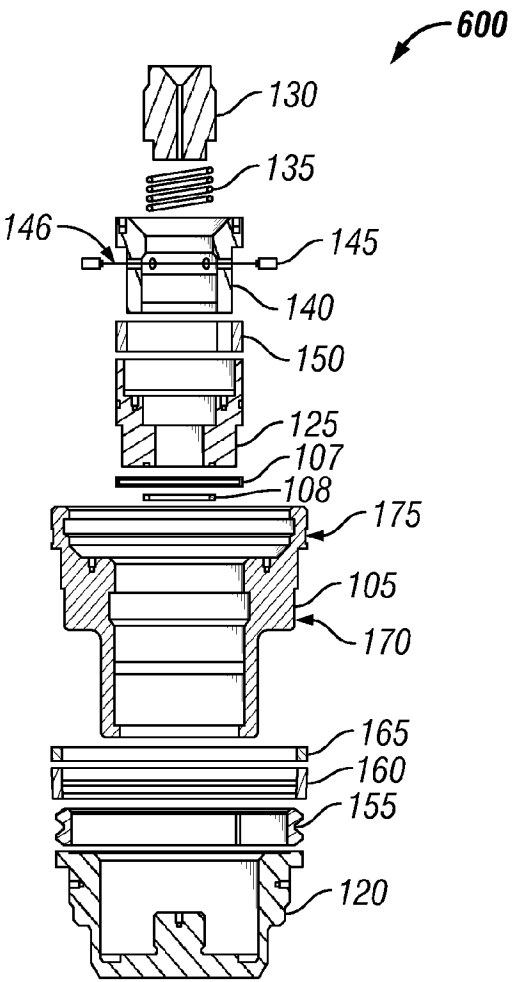
FIG. 6 shows an exploded view of one embodiment of an internal tree cap.

FIG. 6 shows an exploded view of the various components of one embodiment of an internal tree cap 600 and includes additional sealing elements seal pack 107 and O-ring 108 to provide seals between the inner body 125 and the inner housing 105 and the lower housing 120.

In one embodiment, a ROV may be used to run the internal tree cap to the tree spool. Once the internal tree cap has landed on the tree spool, the internal tree cap may be remotely actuated to move an inner housing from the running position to a latched position simultaneously securing the internal tree cap to the tree spool and energizing a sealing element between the exterior of the internal tree cap and the tree spool. While in the latched position, the internal tree cap may provide a collateral beneficial locking means to prevent the upward movement of a tubing hanger within the tree spool. The internal tree cap may be a low profile internal tree cap that is flush or below the top end of the tree spool while in the latched position. The internal tree cap may include a flow bypass or pathway the permits the equalization of pressure, the flushing of the tree cap, or the injection of fluid below the tree cap. The flow bypass or pathway may include a valve means, such as a poppet valve, a p-trap vent, or a one-way check valve, or other device to prevent undesired fluid flow through the flow path depending of the current application.

In one embodiment the internal tree cap may be connected to a running tool, which is used to run the internal tree cap through a marine riser to the tree spool. The running tool includes a releasing means that is used to release the running tool from the internal tree cap once the tree cap has been secured to the tree spool. The releasing means may be actuated by an increase in pressure within a drill string connected to the running tool. Upon landing on the tree spool, an increase in pressure may cause the movement of an inner housing of the internal tree cap to move from a running position to a latched position. The movement of the inner housing to the latched position may simultaneously secure the internal tree cap to a locking profile in the tree spool and energize a bulk seal on the exterior of the tree cap.

Figure 7:
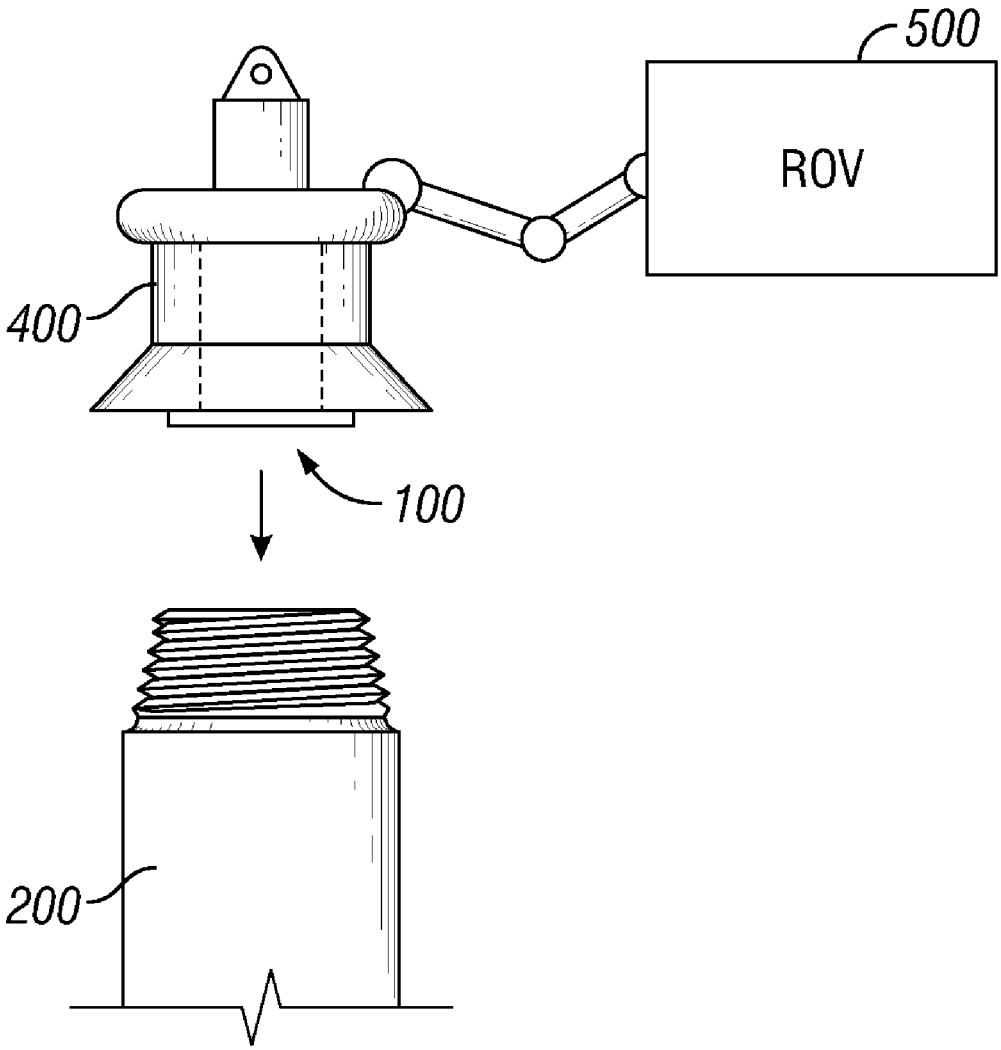
FIG. 7 shows one embodiment of a system used to install an internal tree cap on a tree spool.

FIG. 7 shows one embodiment of a system that may be used to install an internal tree cap 100 onto a tree spool 200. A ROV 500 may be used to transport an internal tree cap 100 connected to a running tool 400 to the tree spool 200. The ROV 500 may remotely actuate the running tool 400 to secure the internal tree cap 100 to the tree spool 200. A sealing element of the internal tree cap 100 may be set or energized simultaneously with securing the internal tree cap 100 to the tree spool 200. The top of the internal tree cap 100 may be installed flush with the top of the tree spool 200. While the tree spool 200 is illustrated as having a threaded external end configuration in FIG. 7, any other suitable configuration can also be employed. This can include any tree spool configurations described herein, such as, for example, the configuration for tree spool 200 illustrated in FIGS. 3 and 5.

Figure 8:
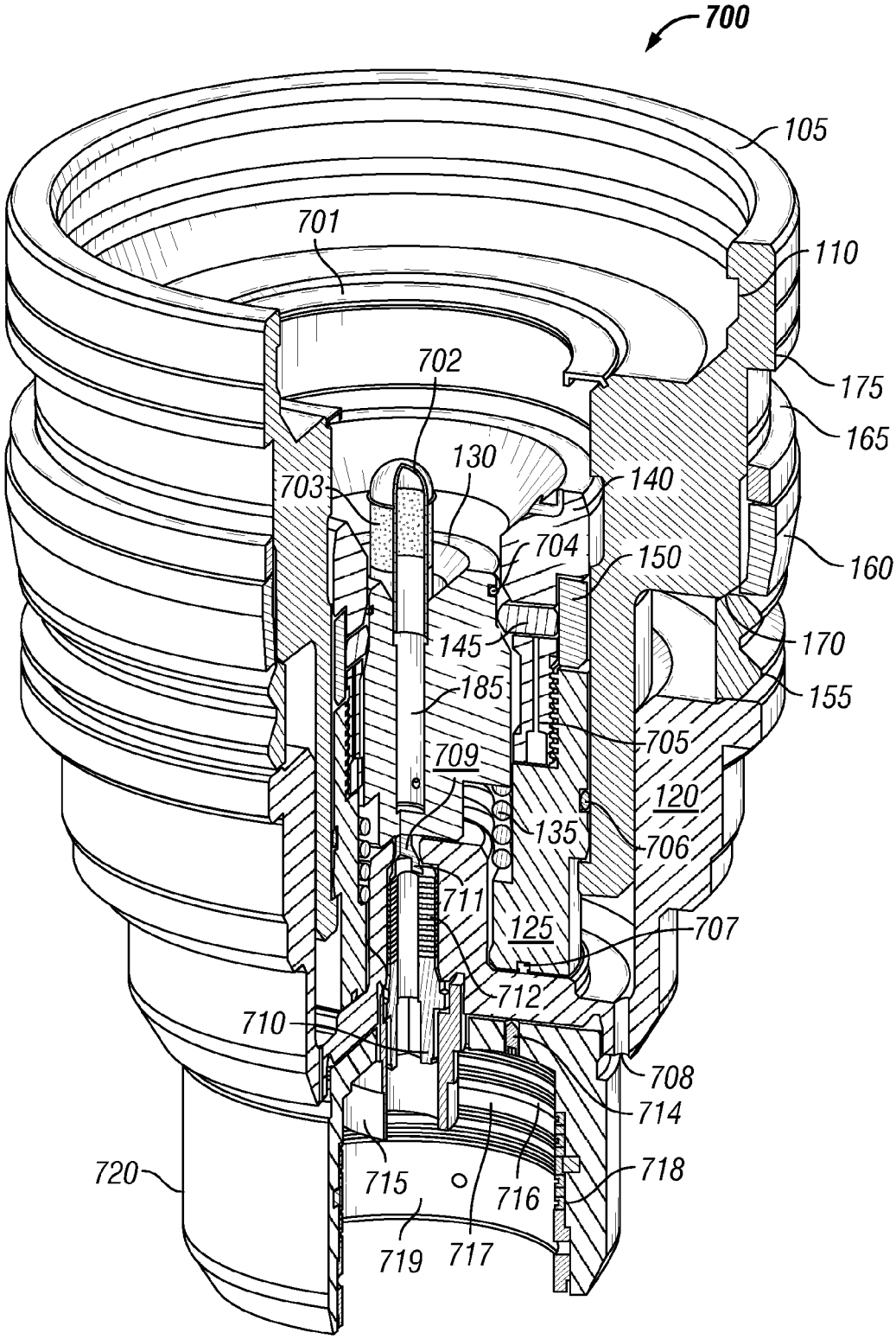
FIG. 8 shows a partial cutaway view of one embodiment of an internal tree cap that includes a lower adapter that seals on the exterior of the upper neck of a tubing hanger.

FIG. 8 shows the partial cutaway view of one embodiment of an internal tree cap 700 that includes a filter 702. The internal tree cap 700 may be transported to the wellhead through a marine riser connected to the wellhead stack. The marine riser is often also used during the drilling the well, which process generally uses drilling mud. As such, residual mud and particulates may remain within the marine riser as the internal tree cap 700 is run through it. These particulates may coat or adhere to the internal tree cap 700 as it passes through the marine riser, which may potentially foul the operating mechanism of the internal tree cap 700. Further once the internal tree cap 700 is installed on the wellhead, the particulates and/or mud may settle out of the column of fluid within the marine riser and accumulate on the internal tree cap 700 presenting a potential problem with the operating mechanisms of the internal tree cap 700. The embodiment shown in FIG. 8 includes elements to decrease the possibility of failure due to the accumulation of mud and/or particulate on the internal tree cap 700.

The majority of the components of the internal tree cap 700 are similar to components discussed in previously discussed embodiments. To the extent possible, similar elements have been identified with the same number and their operation will not be discussed in detail as the operation and workings of these elements have been discussed in detail in regards to FIGS. 1-6.

The internal tree cap 700 includes a fluid passage 185 that permits the removal of fluid trapped by the internal tree cap 700 while being installed onto a tree spool. As would be appreciated by one of ordinary skill in the art having the benefit of this disclosure, the fluid passage 185 may be used to flush tree cap, equalize pressure, or inject fluid below the tree cap. The tree cap includes a filter 702, which may include openings 703 that will prevent the undesired passage of particulates and/or mud into the fluid passage 185. The openings 703 on the filter may be adapted to be positioned above the expected amount of accumulation of particulate on the expansion plug 130 as shown in FIG. 8. Various types of filters may be used to accomplish these purposes as would be appreciated by one of ordinary skill in the art having the benefit of this disclosure.

FIG. 8 shows the internal tree cap 700 in the running in position with the expansion plug 130 depressed in its lower position. Expansion pins 145, as discussed above, may be used to selectively retain the expansion plug 130 in its lower position depressing the spring 135. The ends of the expansion pins 145 may be shaped to engage with a corresponding shape in the face of both the expansion plug 130 and the expansion ring 150. For example, the end of the expansion pins may be conical with corresponding recesses within the faces of expansion plug and expansion ring to provide an adequate interface between the two elements. The use of a conical shaped structure is for illustrative purposes only as various configurations could be employed to provide an adequate interface between the expansion pins and the adjacent elements as would be appreciated by one of ordinary skill in the art having the benefit of this disclosure. The internal tree cap 700 may include a orientation pin 705 connected to the retainer ring 140, which helps to retain the expansion pins 145 in the appropriate radial orientation so that the end of the pins engages the corresponding surfaces in the expansion plug 130 and/or the expansion ring 150.

The internal tree cap includes a poppet valve 710 that permits fluid pass below the internal tree cap 700 through the fluid passage 185. The poppet valve 710 may include a nose 709, a first seating portion 711 (shown in FIG. 9), an integral spring 712, and a second seating portion 713 (shown in FIG. 9). The spring 712 biases the upper portion of the poppet valve 710 so that the first seating portion 711 engages the lower housing 120 creating a seal and preventing fluid flow from traveling through the fluid passage 185 to below the internal tree cap 700. The first seating portion 711 and the second seating portion 713 are adapted to create metal-to-metal seals with the lower housing 120. As shown in FIG. 8, when the expansion plug 130 is in its lower position it pushes against the nose 709 of the poppet valve pushing the first seating portion 711 away from the lower housing 120 permitting fluid flow through the fluid passage 185. In the running position, the expansion plug 130 is in its lower position opening the poppet valve 710 permitting fluid flow through the fluid passage 185. The opening of the fluid passage 185 permits the escape of trapped fluid below the internal tree cap 700 during installation on the tree spool. The internal tree cap 700 may include a nut 715 to secure the poppet valve 710 to the lower housing 120. As illustrated, the spring 712 may be integral to the poppet valve 710. The poppet valve may be a poppet valve including an integral spring as commercially offered by Helical Products Company, Inc. of Santa Maria, Calif. The use of a one piece poppet valve is for illustrative purposes only. A conventional poppet valve or various other mechanisms, such as a check valve, could be utilized to prevent the undesired flow of fluid through the fluid passage as would be appreciated by one of ordinary skill in the art.

The internal tree cap 700 includes a resilient disc element 701 that may provide a seal against the running tool while the internal tree cap 700 is run through the marine riser to the wellhead. The disc element 701 may help to prevent the accumulation of particulate and/or mud on the expansion plug 130 as the internal tree cap 700 is run through the marine riser. Additionally, falling particulate may accumulate on the disc element 701 rather than falling on the expansion plug 130 after the running tool has been disconnected from the internal tree cap 700. The resilient disc element may be comprised of a molded plastic and may be secured within an engaging profile of the inner housing 105 of the internal tree cap 700. Various configurations and materials may be used for the element 701 to help prevent the undesired accumulation of particulate on the internal tree cap 700 as would be appreciated by one of ordinary skill in the art having the benefit of this disclosure.

As discussed above, one potential problem that may be encountered when installing the internal tree cap is removing fluid trapped beneath the internal tree cap. The fluid passage 185 may be used to remove trapped fluid. Trapped fluid may also be a problem between the moving components of the internal tree cap 700. The lower housing 120 of the internal tree cap may include a port 708 to permit the removal of trapped fluid between the inner housing 105 and the lower housing 120.

The internal tree cap 700 may include a lower adapter 720 that is adapted to seal on the exterior surface of the upper neck 305 (shown in FIG. 11) of the tubing hanger 300 (shown in FIG. 4). The lower adapter 720 may include a number of non-metal sealing elements 716-719 to provide a seal on the exterior surface of the upper neck 305. The non-metal sealing elements may be used to prevent the leakage of production fluid and the sealing element may be comprised of hardened plastic. The configuration of the sealing elements 716-719 is for illustrative purposes only as various configurations and materials comprising sealing elements may be used depending on the application as would be apparent to one of ordinary skill in the art having the benefit of this disclosure. The lower adapter 720 may selectively connected to the lower housing. For example, the lower adapter 720 may be threaded to the lower housing 120. This may permit the lower adapter 720 to be added onto an internal tree cap 700 originally constructed without the ability to seal on the outer diameter of the upper neck of the tubing hanger. A set screw 714 may be connected to the interface between the lower housing 120 and the lower adapter 720 to prevent the unwanted unthreading of the two components. Various configurations may be used to connect and secure the lower adapter 720 to the lower housing 120. Alternatively, the lower adapter 720 and lower housing 120 may be of unitary construction as would be appreciated by one of ordinary skill in the art having the benefit of this disclosure.

The internal tree cap 700 may include various sealing elements to prevent fluid flow between the interfaces of the components of the internal tree cap 700. For example, a sealing element 704, such as an o-ring, may be positioned to provide a seal at the interface between the expansion plug 130 and the retainer ring 140. A sealing element 706, such as an o-ring or metal lip seal, may be used to provide a seal at the interface between the inner housing 105 and the inner body 125. A sealing element 707, such as an o-ring or a metal lip seal, may be used to provide a seal at the interface between the inner body 125 and the lower housing 120. Various configurations of sealing elements may be used to prevent fluid flow between the components of the internal tree cap as would be appreciated by one of ordinary skill in the art having the benefit of this disclosure.

Figure 9:
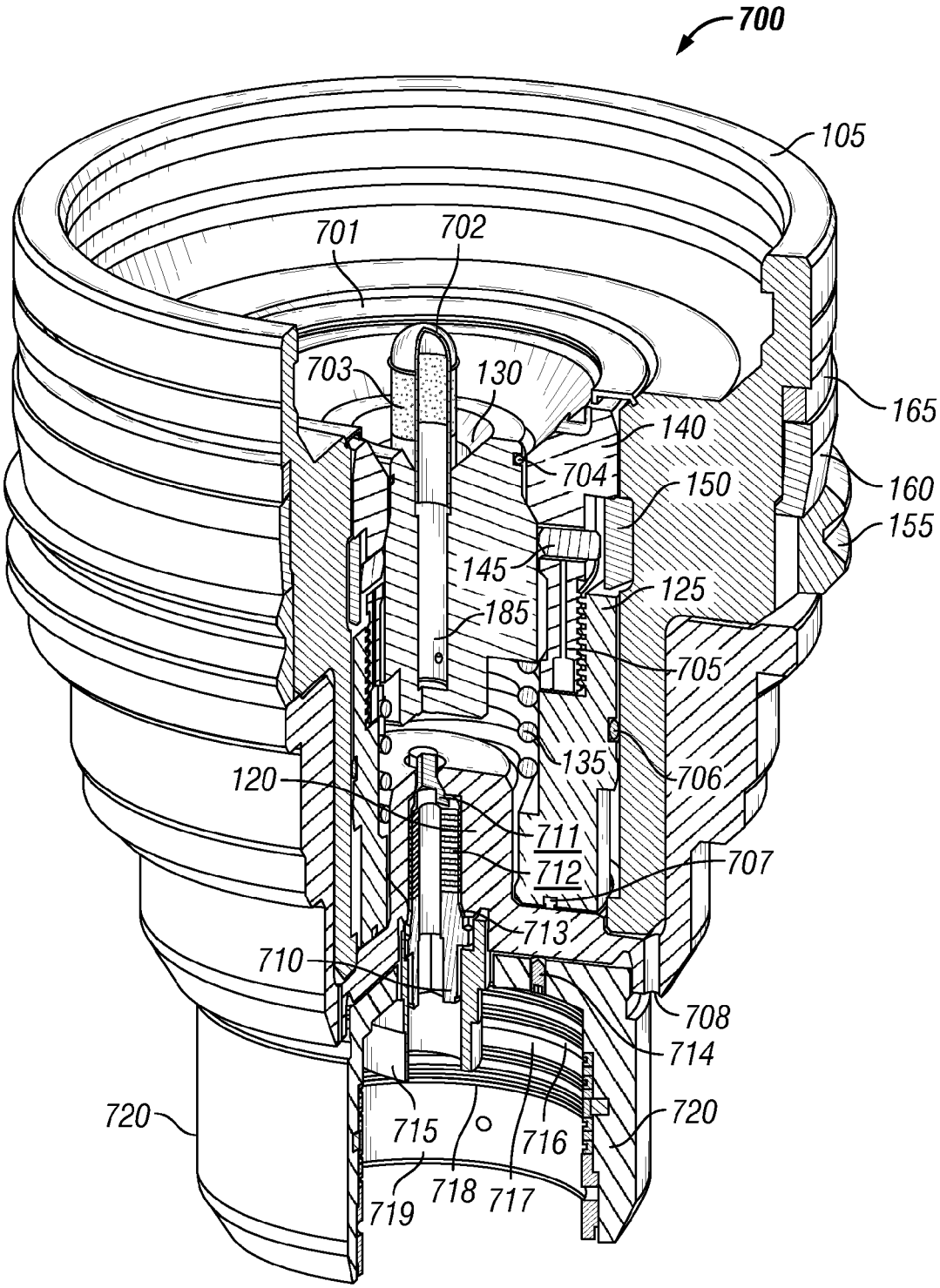
FIG. 9 shows a partial cutaway view of the internal tree cap of FIG. 8 with the inner housing of the internal tree cap moved to the latched position.

FIG. 9 shows the internal tree cap 700 in the landed and latched position. The inner housing 105 has moved down pushing out the split latch ring 155 to engage a locking profile in a tree spool. The movement to the latched position permits the upward movement of the expansion plug 130, which disengages from the nose 709 of the poppet 710 permitting the spring 712 of the poppet 710 to force the first seating portion 711 of the poppet 710 against the lower housing 120 closing the fluid passage 185 through the internal tree cap 700. Prior to removal of the internal tree cap 700 from the tree spool, a running tool may be used to depress the expansion plug 130 pushing the first seating portion 711 away from lower housing 120 opening the fluid passage 185 through the internal tree cap 700. The pressure above and below the internal tree cap 700 may be equalized through the fluid passage 185.

Figure 10:
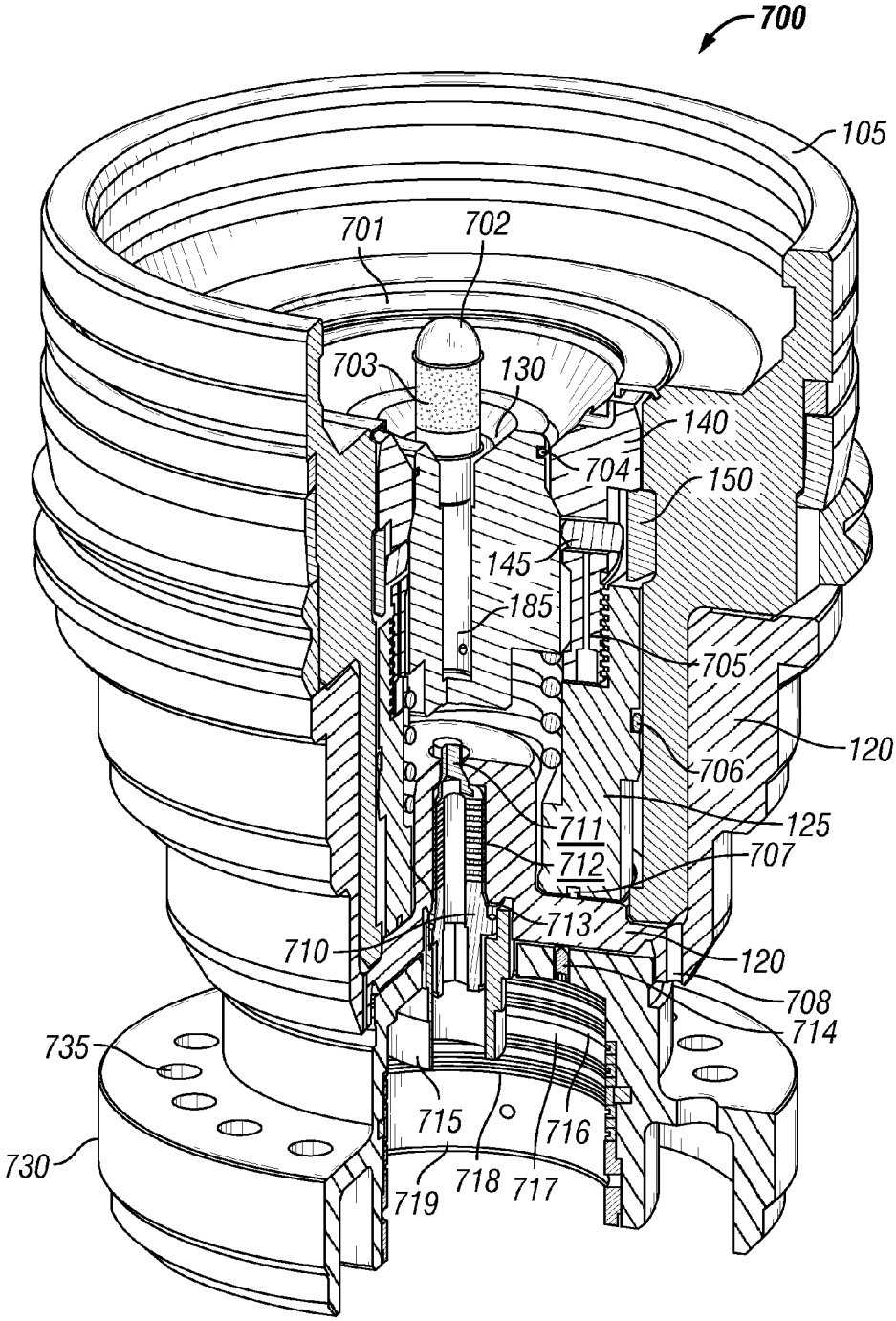
FIG. 10 shows a partial cutaway view of one embodiment of an internal tree cap that includes a lower adapter that both seals on the exterior of the upper neck of a tubing hanger and provides a collateral beneficial locking mechanism for the tubing hanger.

FIG. 10 shows an embodiment of the internal tree cap 700 that includes a lower adapter 730 that has been adapted to engage the top portion of the tubing hanger and act as a collateral beneficial locking means when the internal tree cap 700 has been secured to the tree spool. The lower adapter 730 may include a plurality of openings 735 to permit the passage of fluid past the lower adapter 730. As discussed above, the lower adapter 730 may be selectively connected to the lower housing 120 to permit the addition of the lower adapter 730 to an internal tree cap manufactured without such an adapter. The configuration of the lower adapter may be adapted to engage and secure different tubing hangers as illustrated by the lower adapter 830 and internal tree cap 800 in FIG. 11.

Figure 11:
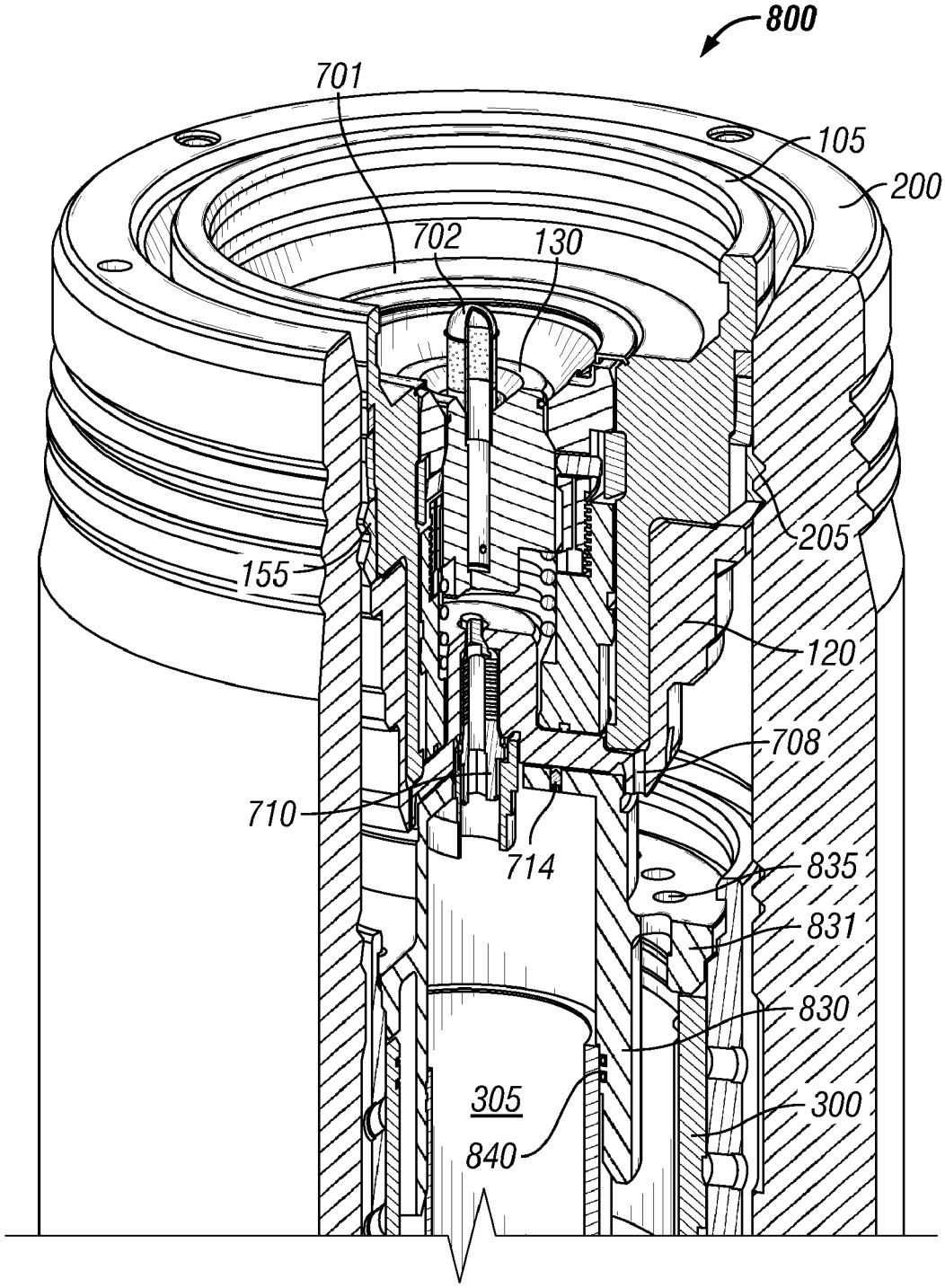
FIG. 11 shows a partial cutaway view of one embodiment of an internal tree cap latched within a tree spool, the internal tree cap including a lower adapter that includes a collateral beneficial locking mechanism for a tubing hanger.

FIG. 11 illustrates one embodiment of an internal tree cap 800 secured to a tree spool 200. The lower housing 105 has moved to the latched position pushing the split latch ring 155 out to engage the locking profile 205 of the tree spool 200. The lower adapter 830 may be adapted with an outer projection 831 that may act as a collateral beneficial locking mechanism to secure the tubing hanger 300 when the internal tree cap 800 is secured to the tree spool 200. The lower adapter 830 may be adapter to engage the tubing hanger 300. The lower adapter 830 may include a plurality of openings 835 to permit fluid to flow past the lower adapter 830 while the internal tree cap 800 is installed into the tree spool 200. The movement of the inner housing 105 permits the tree cap to simultaneously engage the tree spool 200, set the bulk seal 165, and secondarily lock down the tubing hanger 300. The lower adapter 830 may include a sealing element 840 or a plurality of sealing elements to provide a seal between the lower adapter 830 and the upper neck 305 of the tubing hanger 300. The sealing elements may be one of various sealing elements, such as an o-ring or metal lip seal, as would be appreciated by one of ordinary skill in the art having the benefit of this disclosure.

Figure 12:
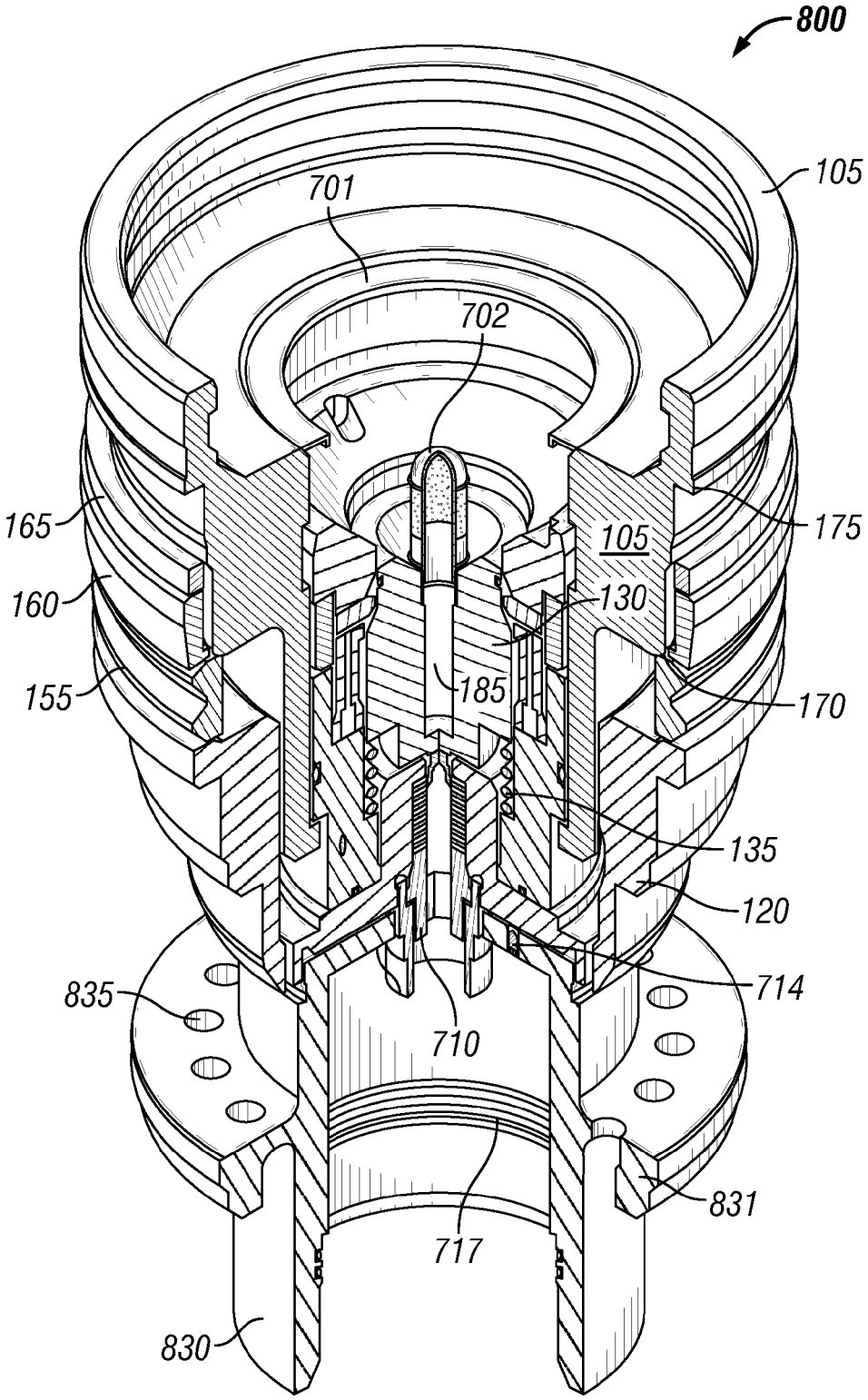
FIG. 12 shows a partial cutaway view of the internal tree cap of FIG. 11 with the tree cap in the running in position.
Figure 13:
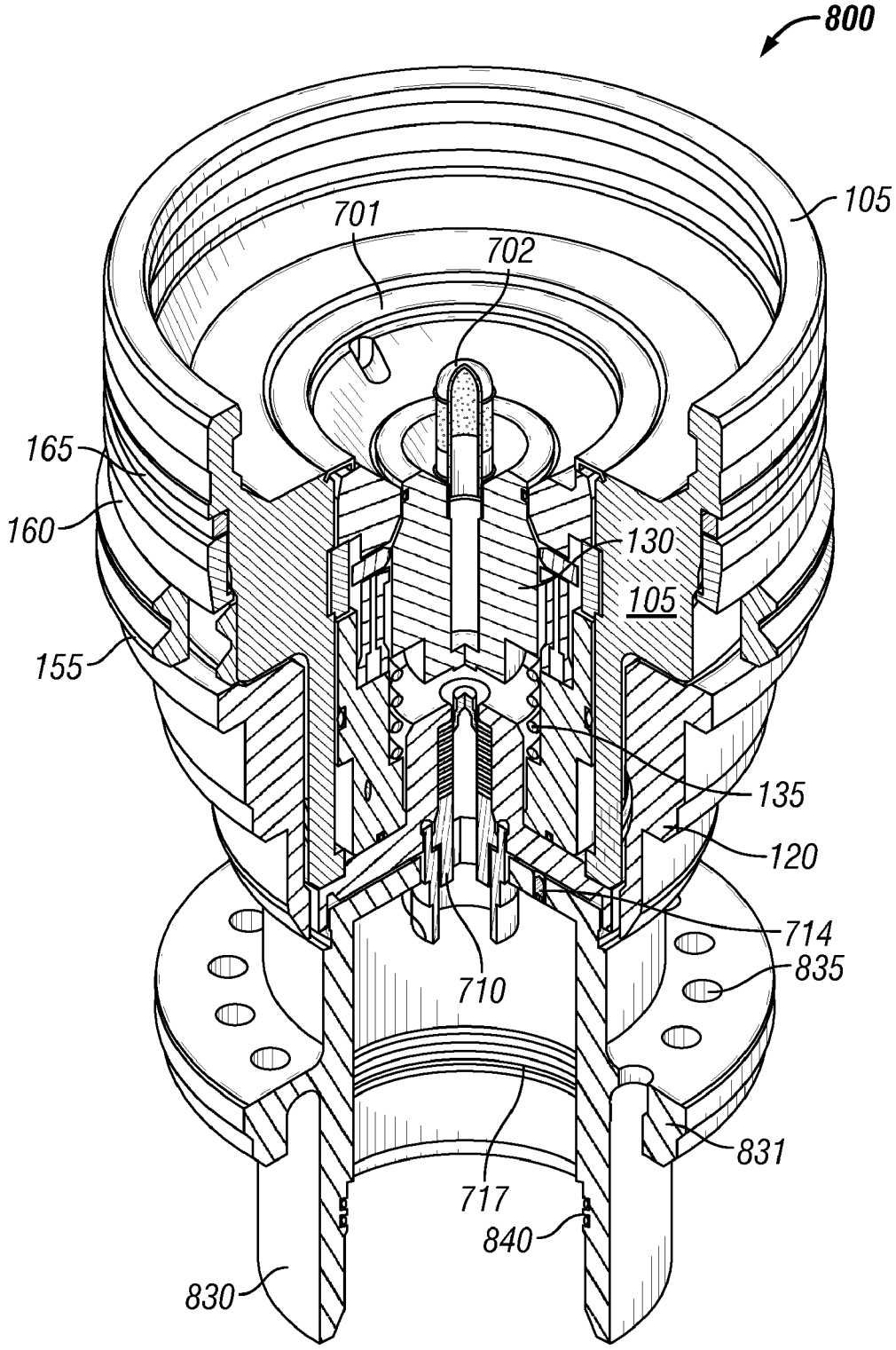
FIG. 13 shows a partial cutaway view of the internal tree cap of FIG. 11 with the tree cap in the latched position.

FIGS. 12 and 13 illustrate the internal tree cap 800 of FIG. 11 alone without the tree spool. FIG. 12 shows the internal tree cap 800 in the running position with the fluid passage 185 open. FIG. 13 illustrates the internal tree cap 800 in the latched positioned with the poppet valve 710 closing the fluid passage 185 through the internal tree cap 800.

Figure 14:
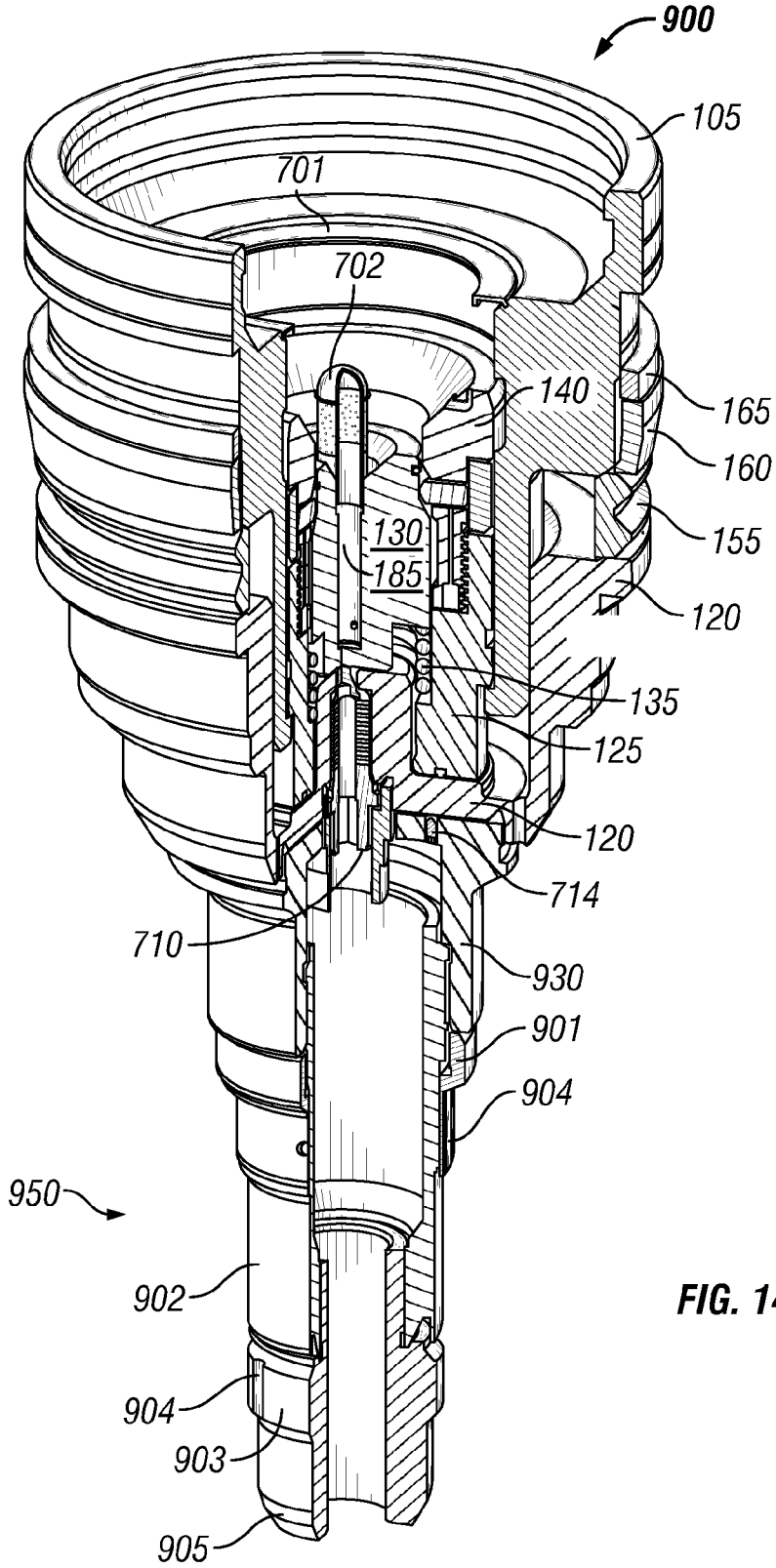
FIG. 14 shows a partial cutaway view of one embodiment of an internal tree cap that includes a stinger adapted to seal in the upper plug sealing profile of a tubing hanger.
Figure 15:
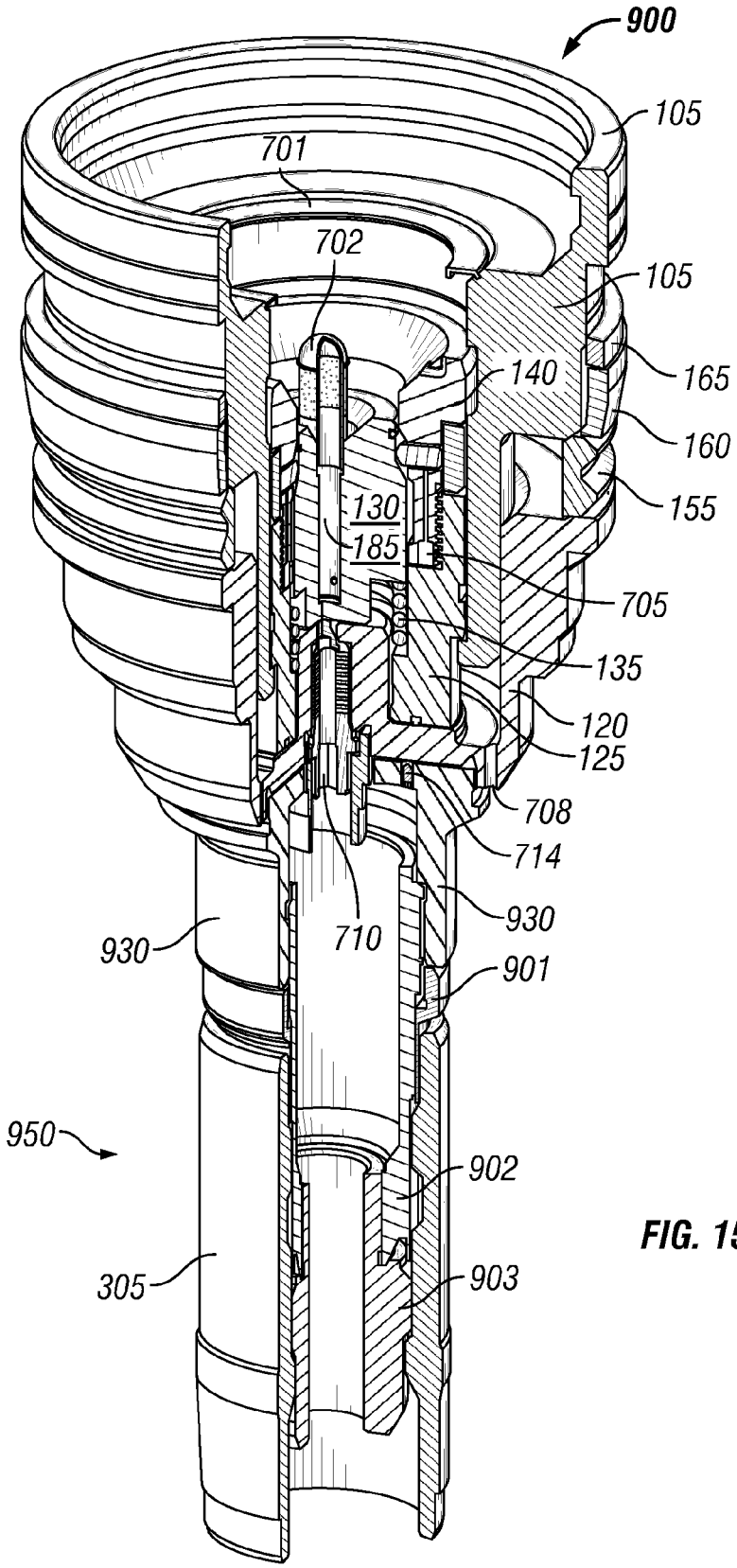
FIG. 15 shows a partial cutaway view of the internal tree cap of FIG. 14 with the stinger inserted into the upper neck of a tubing hanger.

FIG. 14 illustrates one embodiment of an internal tree cap 900 that includes a stinger 950 connected to a lower adapter 930. The lower adapter 930 may be selectively connected to the lower housing 120 of an internal tree cap permitting the lower adapter 930 and stinger 950 to be connected to an internal tree cap originally manufactured without these components. FIG. 14 shows the internal tree cap 900 in the running in position. The stinger 950 is adapted to provide a seal between the stinger and the upper plug seal profile 310 (shown in FIGS. 16 and 17) in an upper neck 305 of a tubing hanger 300 or alternatively in the upper plug seal profile in a tubing hanger crossover. The stinger 950 includes an upper guide sleeve 901, a sealing portion 902, and a lower guide sleeve 903. The guide sleeves 901, 903 may aid proper orientation of the stinger 950 during insertion into the upper neck 305. The guide sleeves may be comprised of a suitable material for construction of a subsea component, such as DELRIN, that may be adapted to minimize potential damage to the tubing hanger neck. The guide sleeves 901, 903 may include slots 904 to permit fluid to flow past the stinger 950 while the stinger 950 is inserted into the tubing hanger 300. FIG. 15 shows the stinger 950 inserted within the upper neck 305 of the tubing hanger 300.

In an alternative embodiment, a chamfered edge 905 of the stinger 950, shown in FIG. 14, can be configured to seal against the tubing hanger 300. In an embodiment, an additional seal, such as a sealing ring (not shown), can be included at position 905 to help provide the desired seal.

Figure 16:
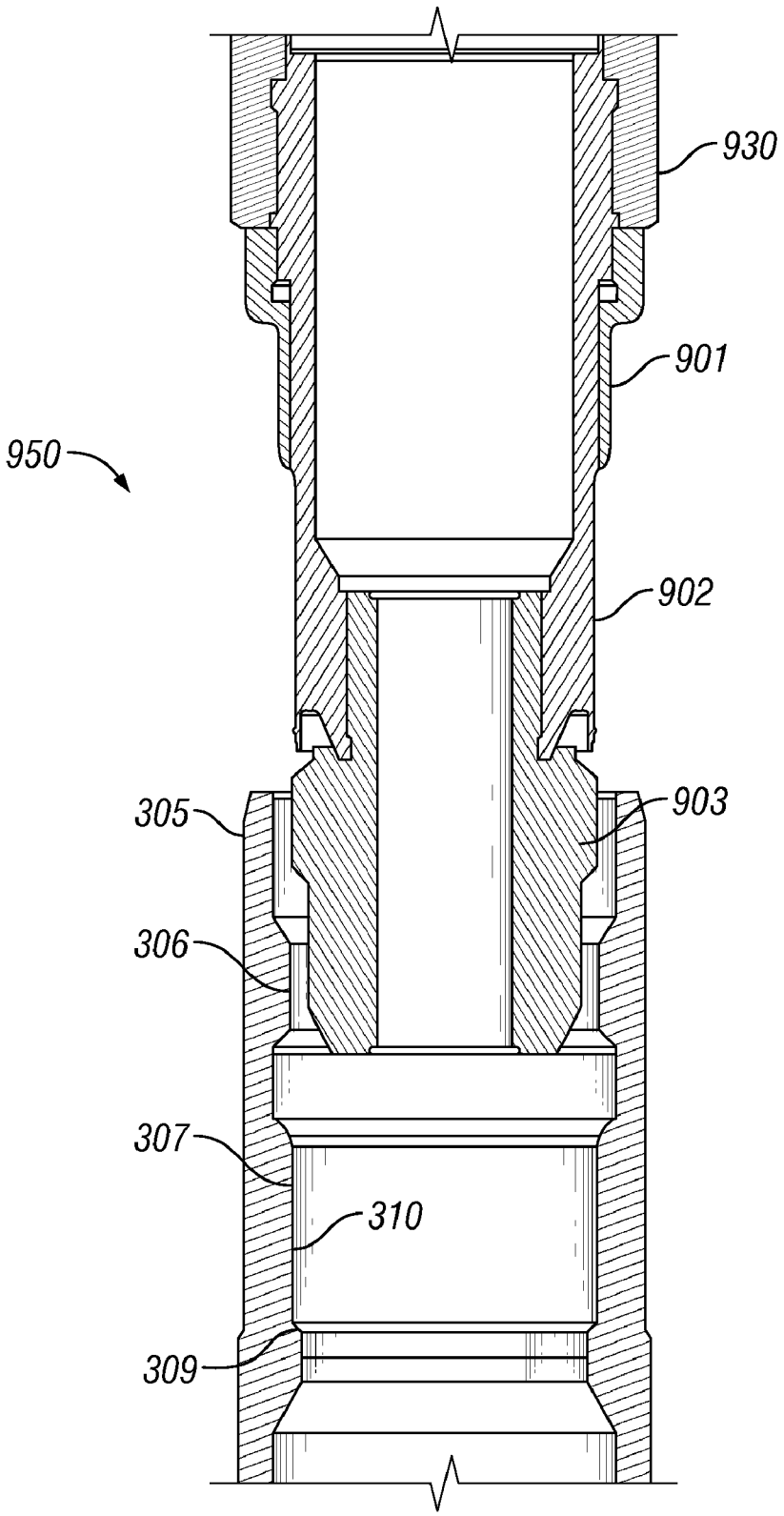
FIG. 16 shows a cross-section close-up view of a stinger being inserted into the upper neck of a tubing hanger.

FIG. 16 shows a cross-section view of a close-up of the stinger 950 first being inserted into the upper neck 305. The stinger 950 includes a sealing portion 902 positioned between a lower guide sleeve 903 and an upper guide sleeve 901. Upon insertion into the upper neck 305, the lower guide sleeve 903 will first contact a first guidance profile 306 in the upper neck 305. The diameter of the first guidance profile 306 is adapted to help vertically orient and guide the stinger 950 into the tubing hanger.

Figure 17:
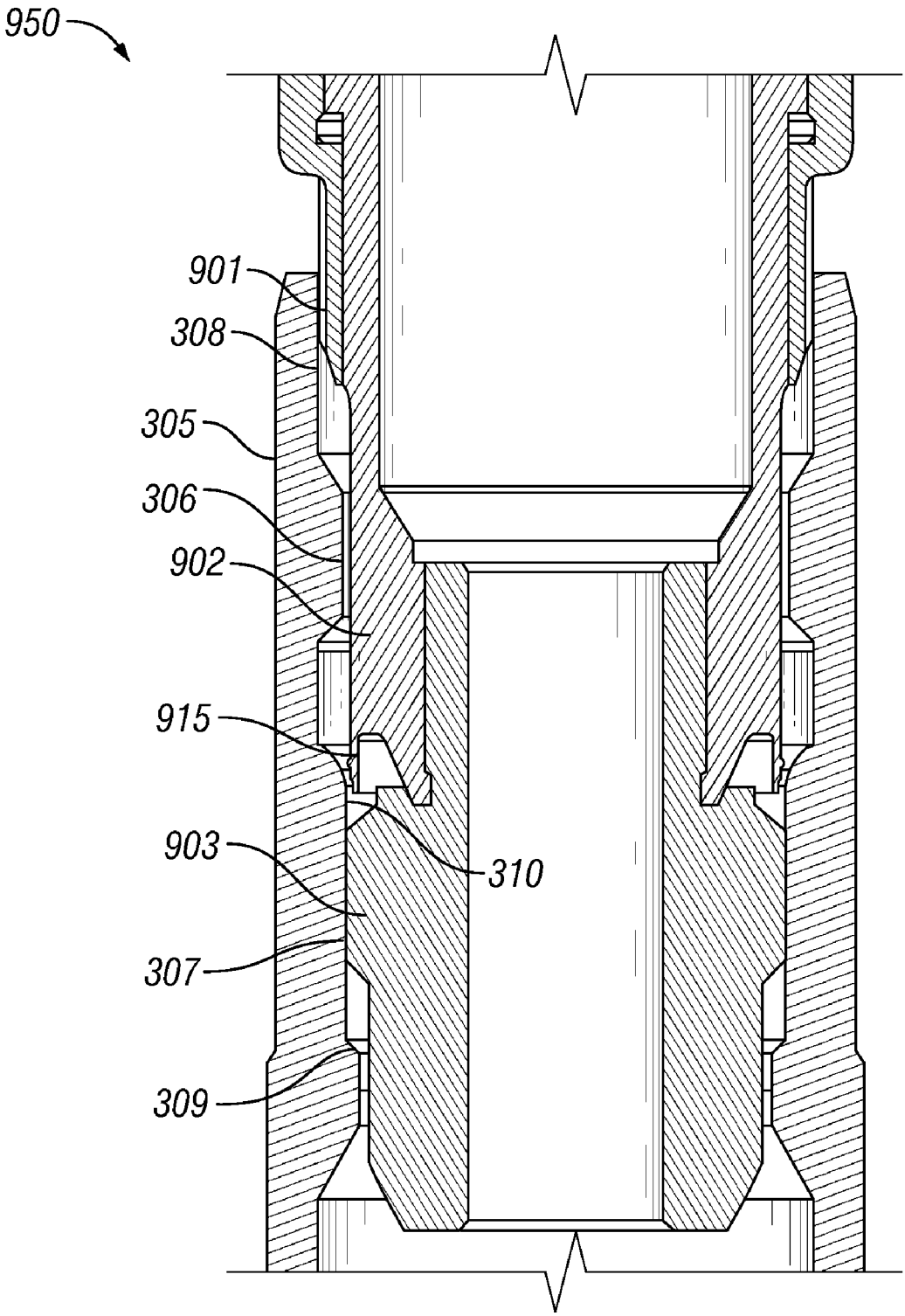
FIG. 17 shows a cross-section close-up view of a stinger being run into the upper neck of a tubing hanger.
Figure 18:
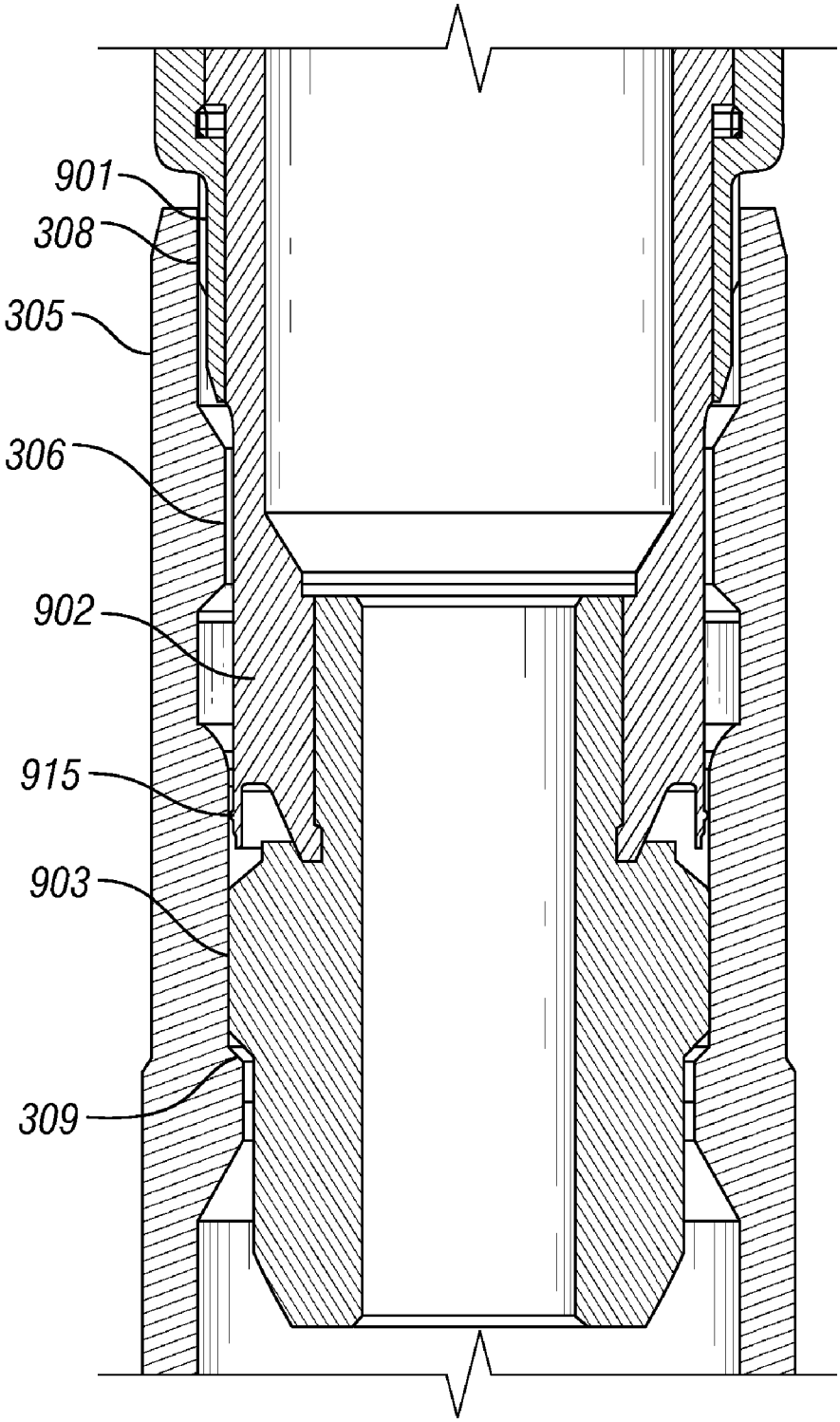
FIG. 18 shows a cross-section close-up view of the stinger landed in the upper neck of a tubing hanger providing a metal-to-metal seal in the upper plug sealing profile of the tubing hanger.

The upper neck 305 includes a second guidance profile 307 that is located below the first guidance profile 306. The second guidance profile 307 has a smaller inner diameter than the first guidance profile 306 to better orient the stinger 950 during insertion into the tubing hanger. As the lower guide sleeve 903 contacts the second guidance profile 307, the upper guide sleeve 901 contacts the inner upper diameter 308 of the upper neck 305. The engagement between the inner upper diameter 308 and the second guidance profile 307 provides dual guidance to the stinger 950. The dual guidance points help to ensure the stinger 950 is vertical before setting the seal within the upper plug seal profile 310 to help prevent damage to the seal during insertion of the stinger 950. The inner bore of the second guidance profile is the upper plug seal profile 310. FIG. 17 shows the stinger 950 positioned with the sealing portion 902 located above the upper plug seal profile 310. The stinger 950 is inserted within the tubing hanger until the lower guide sleeve 903 contacts a shoulder 309 of the tubing hanger. The shoulder 309 prevents further downward movement of the stinger 950. At this position, a sealing element 915 of the sealing portion 902 is positioned to create a seal against the upper plug seal profile 310 as shown in FIG. 18. The sealing element 915 may be a metal lip seal that creates a metal-to-metal seal with the upper plug seal profile 310.

Figure 19:
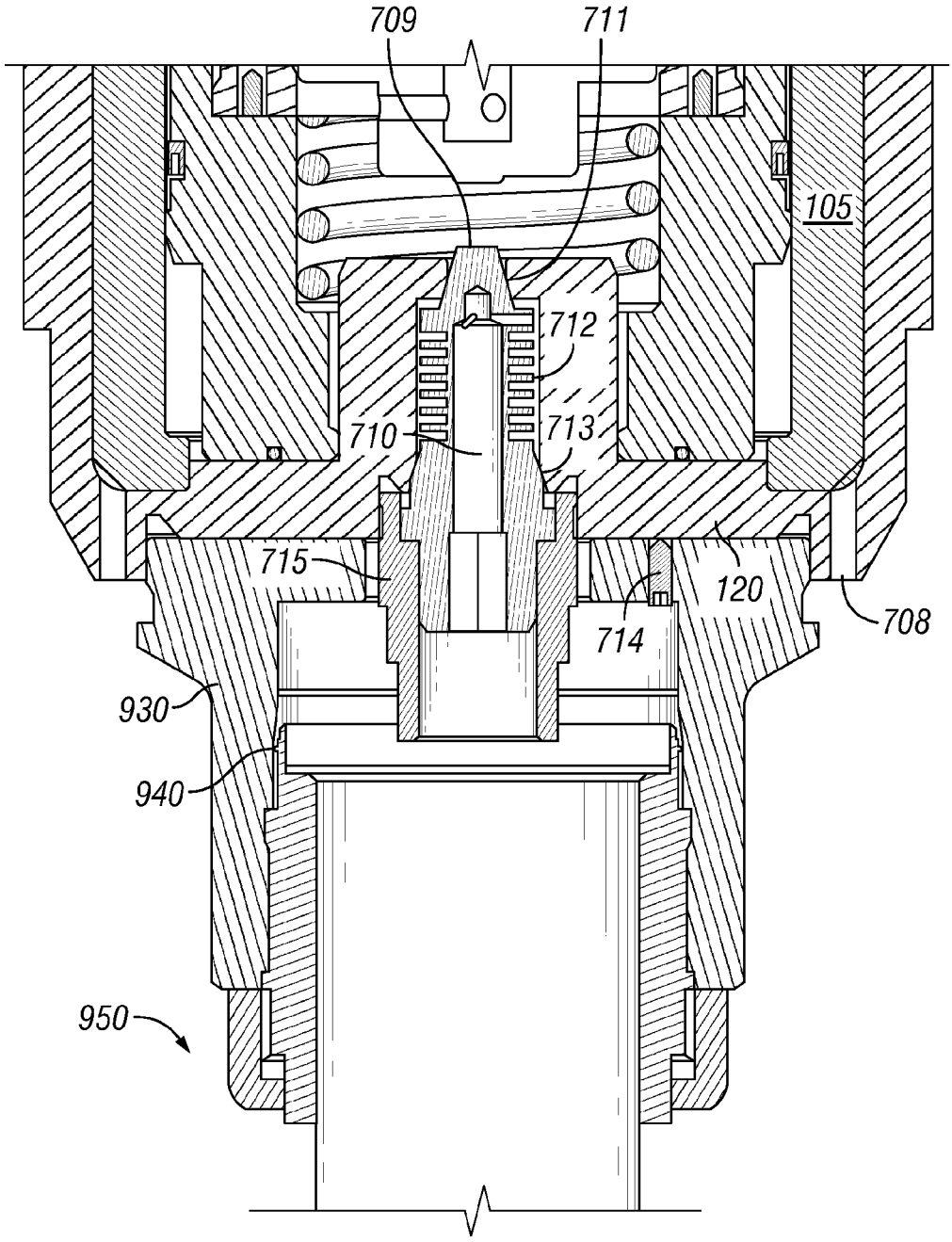
FIG. 19 shows a cross-section view of a portion of an internal tree cap that may be used in connection with a gas lift operation of a well.

FIG. 19 shows a cross-section view of the interface between the lower housing 120 and the lower adapter 930 and the interface between the lower adapter 930 and the stinger 950. FIG. 19 illustrates the running tool released from the internal tree cap allowing the poppet 710 to create a metal-to-metal seal between the first seating portion 711 and the lower housing. The second seating portion 713 also creates a metal-to-metal seal between the poppet 710 and the lower housing 120. The stinger 950 may include a metal lip seal 940, which creates a metal-to-metal seal between the stinger 950 and the lower adapter 930. FIG. 19 also illustrates a port 708 through the lower housing 120, which permits the removal of fluid within the cavity of the lower housing 120 as the inner housing 105 moves downward to the latched position.

Figure 20:
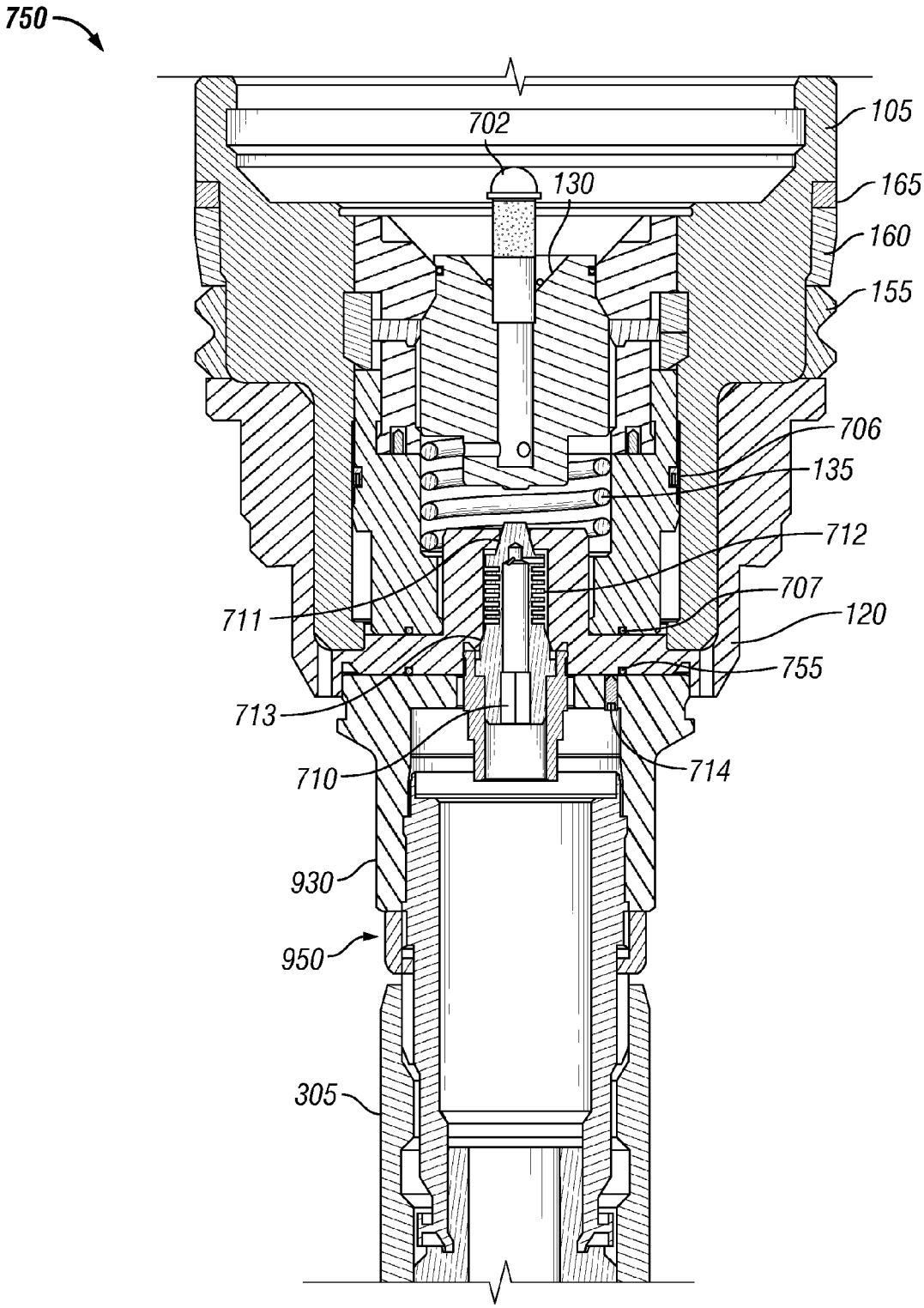
FIG. 20 shows a cross-section view of an internal tree cap that includes a sealing stinger that may be used in connection with a gas lift operation of a well.
Figure 21:
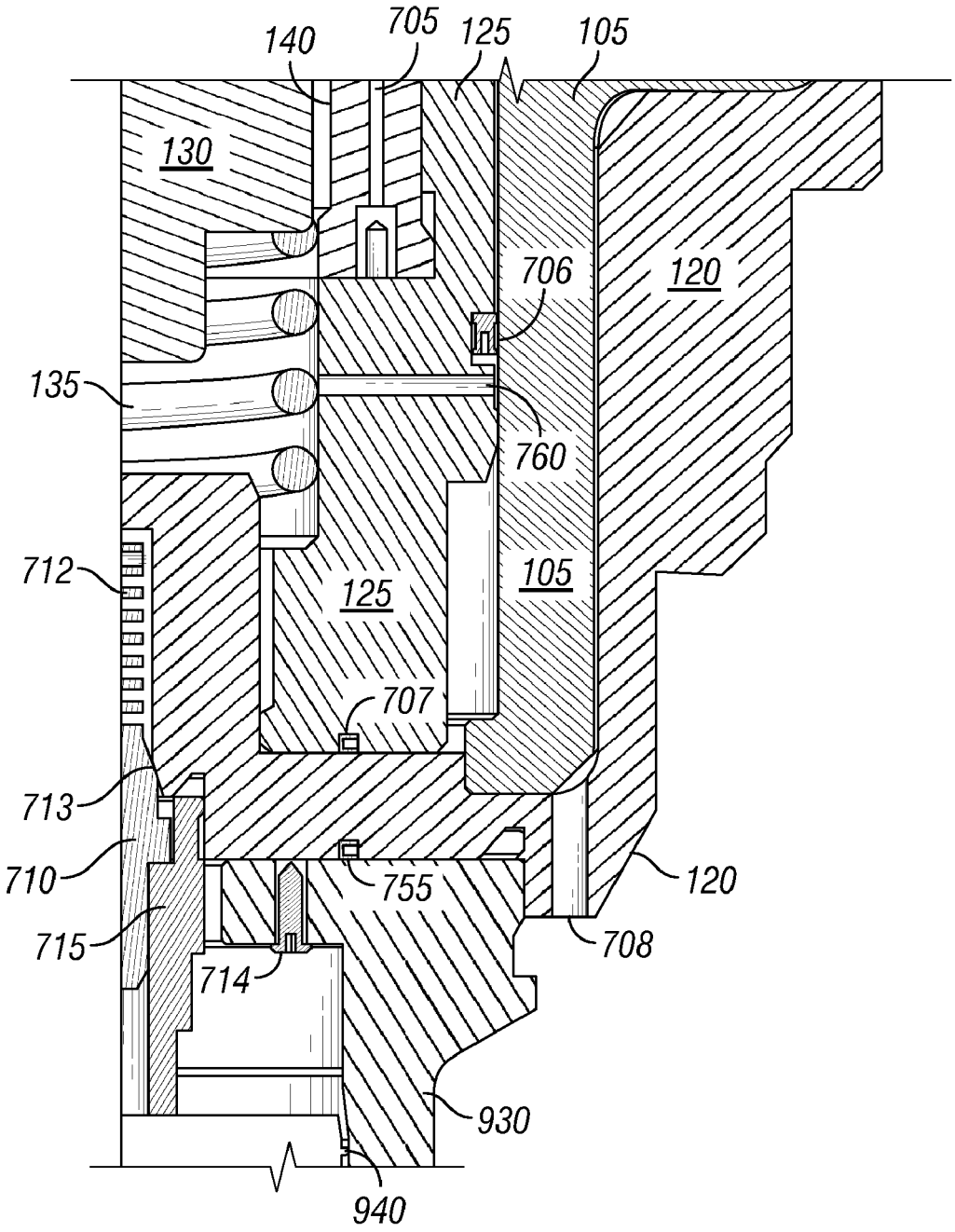
FIG. 21 shows a cross-section close-up view of a portion of an embodiment of an internal tree cap that provides metal-to-metal seals for use with a gas lift operation of a well.
Figure 22:
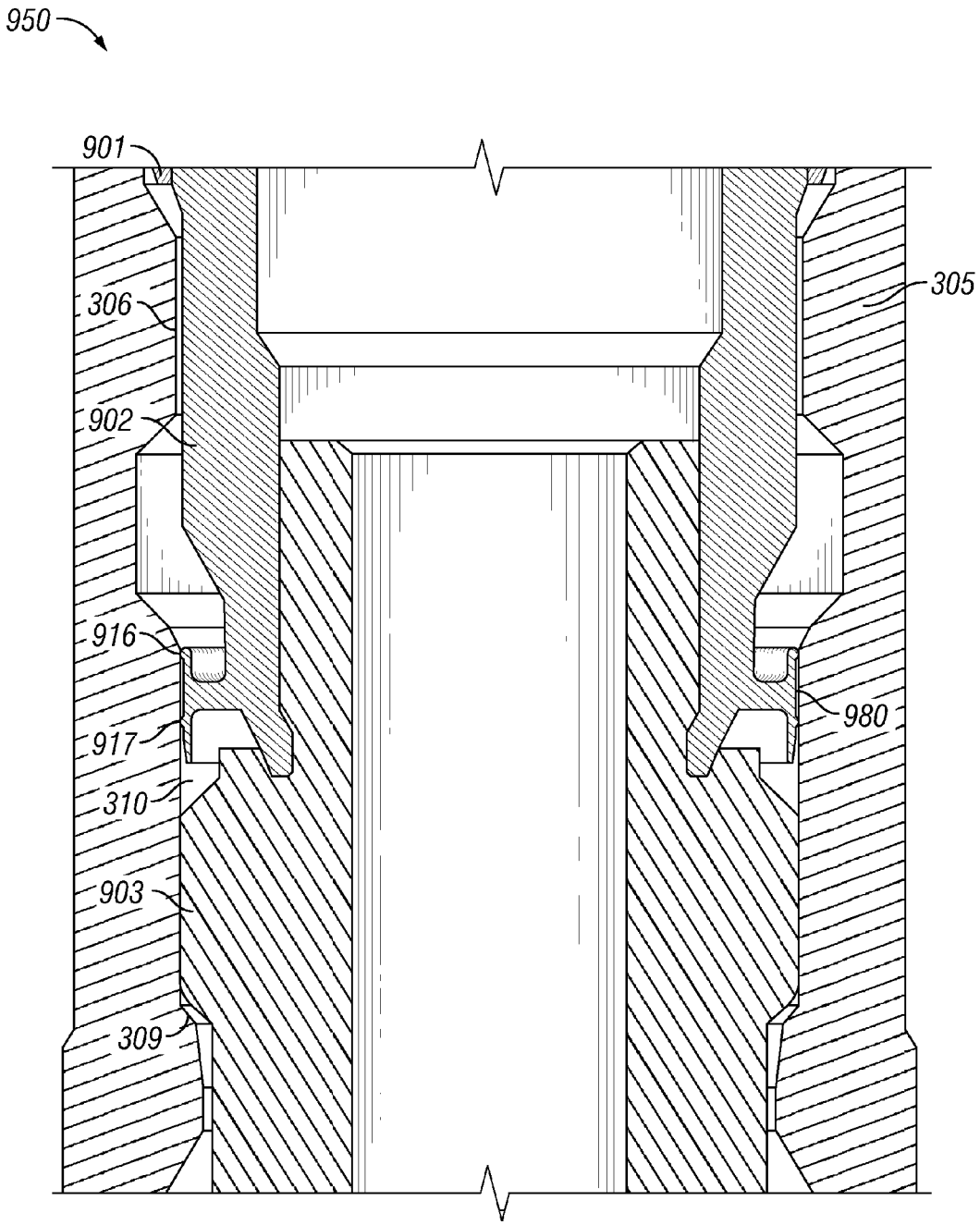
FIG. 22 shows a cross-section close-up view of a portion of an embodiment of a stinger that provides for a bi-directional metal-to-metal seal within the upper plug sealing profile of the tubing hanger.

FIGS. 20-22 show one embodiment of an internal tree cap 750 that may be used in with a gas lift on the well. FIG. 20 shows a cross-section of the internal tree cap 750 that prevents fluid flow through the internal tree cap 750 with metal-to-metal seals provided by the poppet 710. Sealing elements 706, 707, and 755 prevent fluid leakage between the various components of the internal tree cap 750. In particular, sealing element 755 prevents fluid leakage between the lower housing 120 and the lower adapter 930. The internal tree cap may include radial flow ports 760 as shown in FIG. 21 which permit the removal of trapped fluid as the internal tree cap is simultaneously secured to the tree spool and the seals are set preventing fluid flow through and around the tree cap. The stinger 950 may include a metal sealing element to prevent fluid leakage between the stinger 950 and lower adapter 930 interface. The stinger 950 may include a bi-directional sealing element 980. The bi-directional sealing element may comprise two metal lip sealing elements 916, 917 that provide a bi-directional seal when set within the upper plug seal profile 310 of the tubing hanger as shown in FIG. 22.

Figure 23:
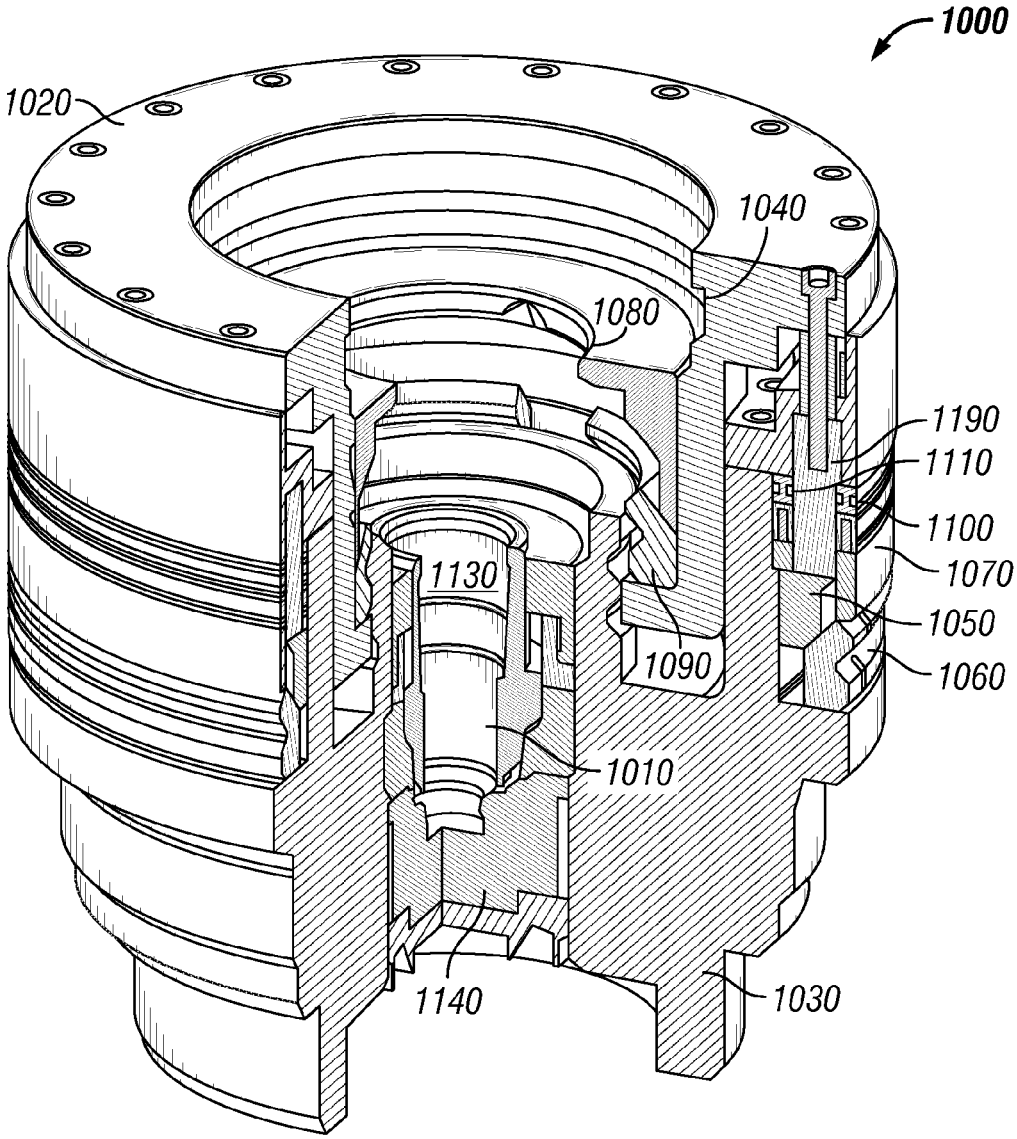
FIG. 23 shows a partial cross-section view of an internal tree cap that includes a wireline plug profile in a running-in position.
Figure 24:
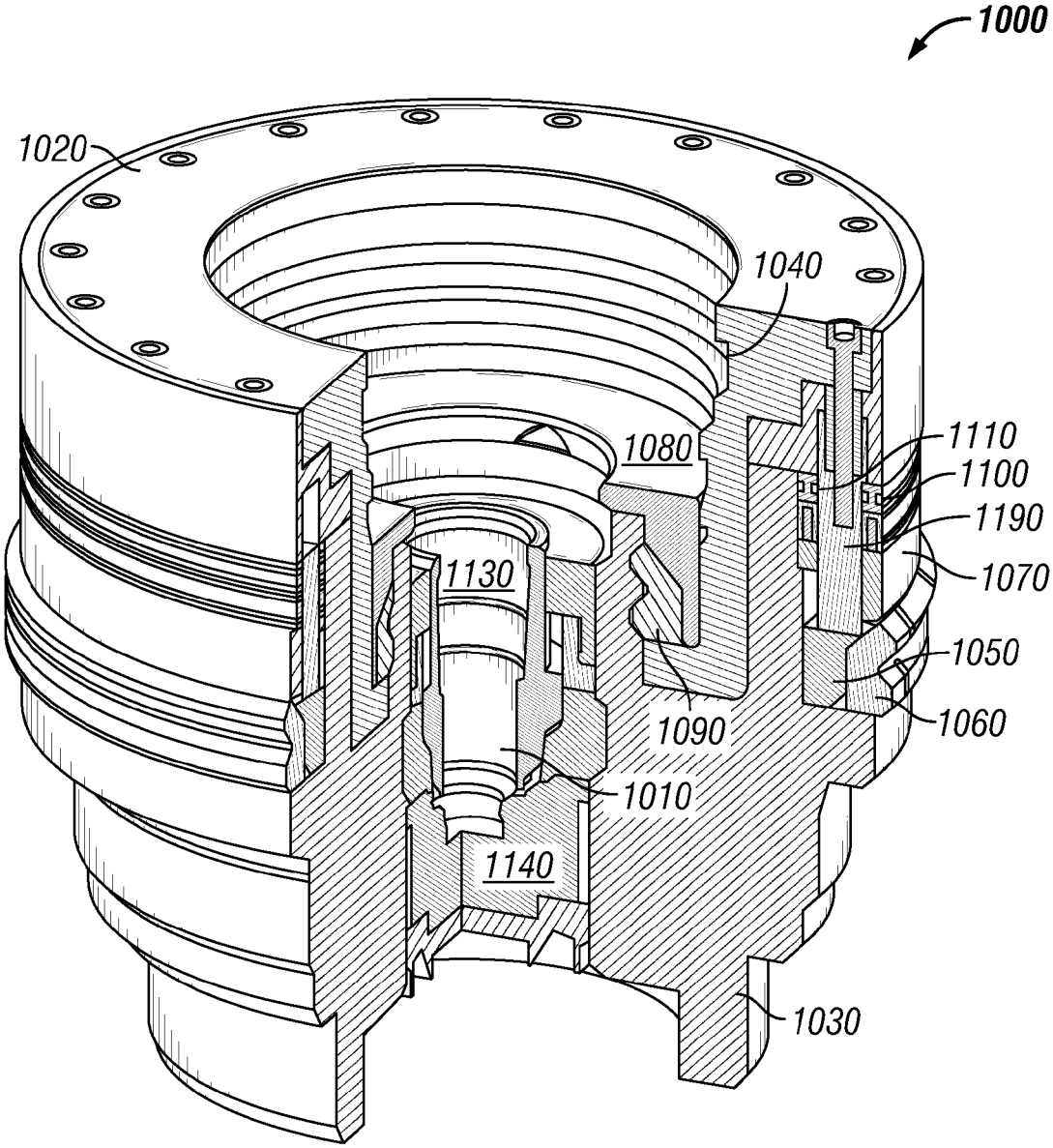
FIG. 24 shows a partial cross-section view of an internal tree cap that includes a wireline plug profile in a landed or latched position.

FIGS. 23-27 illustrate one embodiment of the present disclosure an internal tree cap 1000 that includes a cavity 1010 having a profile to accept a wireline plug. FIG. 23 shows a cross-section view of the internal tree cap 1000 in a running position. The internal tree cap 1000 includes an upper housing 1020 and lower housing 1030. The upper housing 1020 includes a locking profile 1040 that may be adapted to engage a running tool, such as the running tool 400 shown in FIG. 7. The locking profile 1040 is shown is for illustrative purposes only and may be adapted to engage various running or setting tools as would be appreciated by one of ordinary skill in the art having the benefit of this disclosure. The upper housing 1020 includes a central bore running the length of the housing. The upper housing 1020 is movable between an upper or running position, as shown in FIG. 23, and a lower or latched position, as shown in FIG. 24. The lower housing 1030 is adapted to receive the lower end of the upper housing 1020 when it is moved into its lower position. A set ring 1050, positioned around the lower housing 1030, is movable between an upper position, as shown in FIG. 23, and a lower position, as shown in FIG. 24. The set ring 1050 is fixed to the upper housing 1020 in such a way that the set ring 1050 and upper housing 1020 move between respective upper and lower positions in sync with each other as shown in FIGS. 23 and 24.

An outer split latch ring 1060 is positioned around the exterior of the internal tree cap 1000. The outer split latch ring 1060 is movable between an inner position, as shown in FIG. 23, and an outer position, as shown in FIG. 24. While the outer split latch ring 1060 is in the inner position, the set ring 1050 rests on the outer split latch ring 1060. The downward movement of the set ring 1050 as the upper housing 1020 moves to the lower or latched position pushes the outer split latch ring 1060 outward to its outer position.

A lock device 1080 and inner split latch ring 1090 are located inside an annular cavity between the upper housing 1020 and lower housing 1030. A bottom edge of the inner split latch ring 1090 abuts an inward-facing lip of the upper housing 1020. The inner split latch ring is movable between an outer position, as shown in FIG. 23, and an inner position, as shown in FIG. 24. As shown in FIG. 23, while the inner split latch ring 1090 is in the outer position, the lock device 1080 rests on the inner split latch ring 1090. While the upper housing 1020 is in the latching position, a downward movement on the lock device 1080 pushes the inner split latch ring 1090 inward to its inner position. While the lock device 1080 remains in a lower or locked position, as shown in FIG. 24, the lock device 1080 exerts inward pressure onto the inner split latch ring 1090, thus holding it in its inner position. In its inner position, inward-facing grooves and ridges on the inner split latch ring 1090 interface with corresponding outward-facing grooves and ridges on the lower housing 1030. While the inner split latch ring 1090 grooves and ridges and the lower housing 1030 grooves and ridges are so interconnected, and the lock device 1080 remains in its lower position, the inner split latch ring 1090 cannot be moved upward in relation to the lower housing 1030, which likewise prevents the upper housing 1020 from upward movement in relation to the lower housing 1030. While the upper housing 1020 is thus prevented from moving to its upper position, the set ring 1050 cannot be moved into its upper position, which in turn prevents the outer split latched ring 1060 from moving into its inner position.

A support ring 1070 is positioned above the outer split latch ring 1060 about the exterior of the internal tree cap 1000. Above the support ring 1070 is an outer sealing assembly 1100. The internal tree cap 1000 further includes an inner sealing assembly 1110 positioned around the lower housing 1030.

Figure 25:
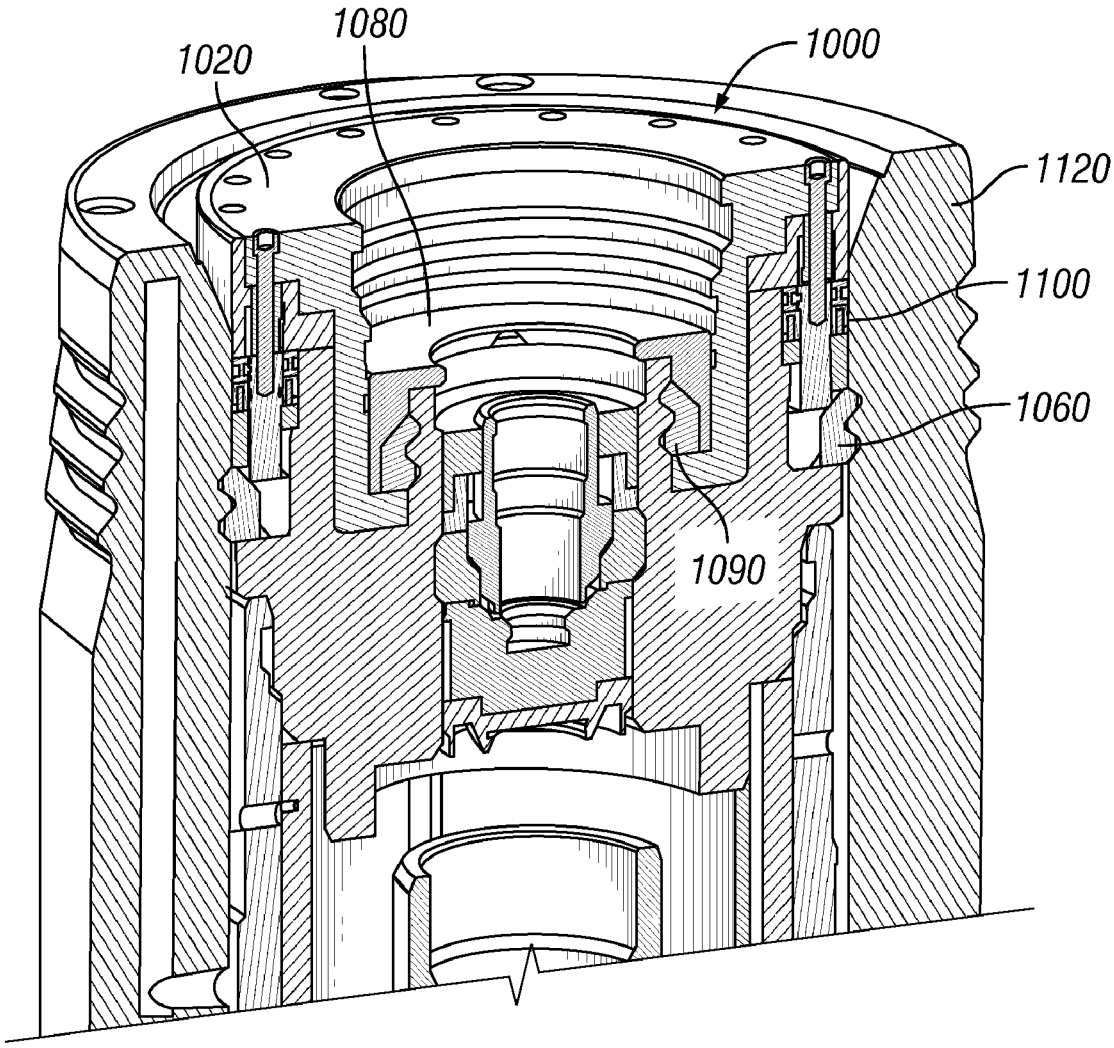
FIG. 25 shows a cross-section view of an internal tree cap that includes a wireline plug profile landed in a tree.

FIG. 25 shows a cross-section view of the internal tree cap 1000 in a tree spool 1120 with the upper housing 1020 in a lower or latched position and the lock device 1080 in a lower or locked position. As discussed above, while the lock device 1080 is in its locked position, the upper housing 1020 cannot be moved to its upper position, which prevents the outer split latch ring 1060 from being moved to its inner position. As shown in FIG. 25, ridges and grooves, or a mating profile, around an outer edge of the outer split latch ring 1060 interface with corresponding ridges and grooves, or a mating profile, on an inner surface of the tree spool 1120, which prevents removal of the internal tree cap 1000 from the tree spool 1120. While the internal tree cap 1000 is latched into a tree spool 1120, the outer seal assembly 1100 remains in contact with the tree spool 1120 inner surface.

Figure 26:
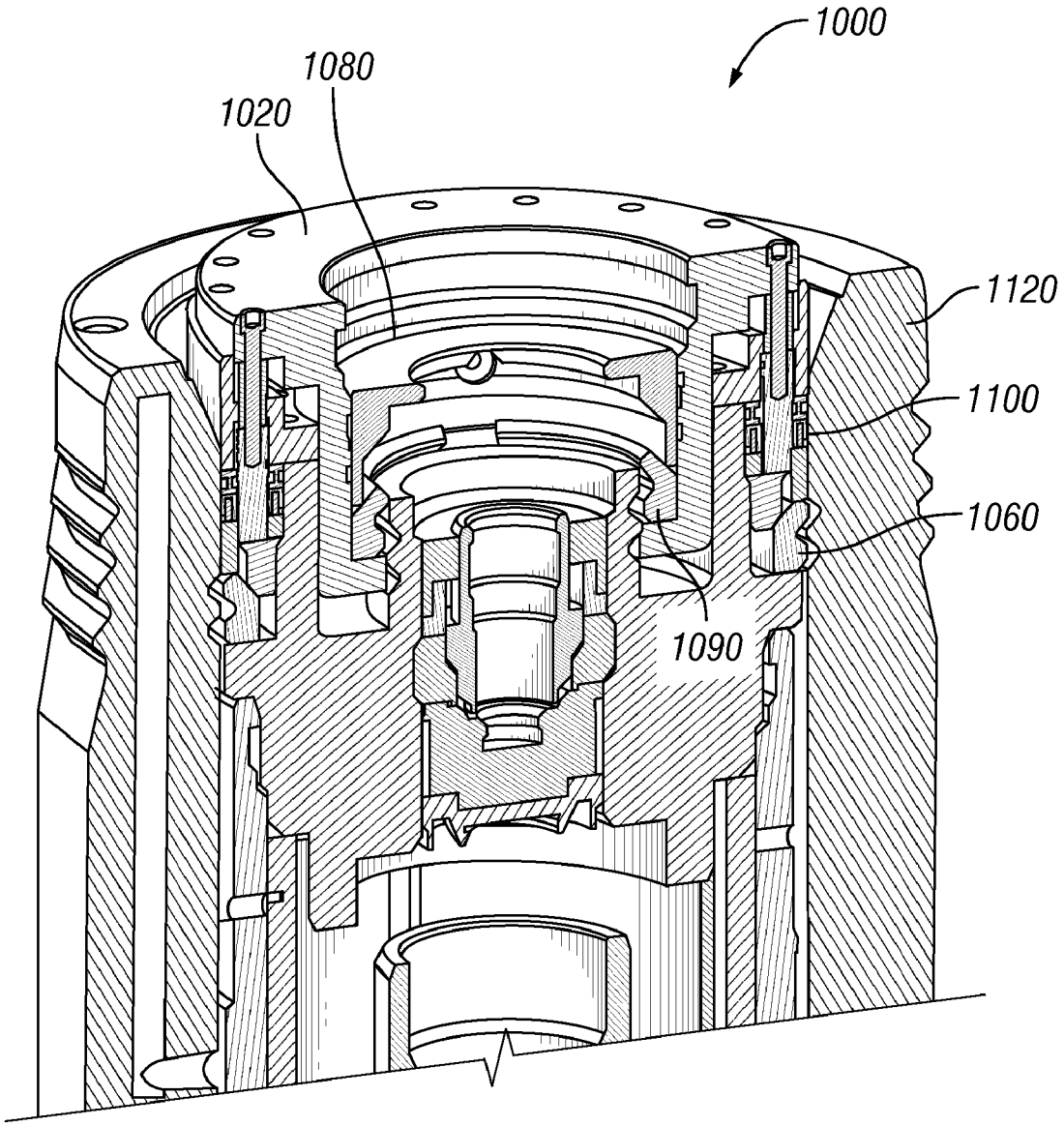
FIG. 26 shows a cross-section view of an internal tree cap that includes a wireline plug profile in a running-in position with the internal tree cap landed, but not locked in a tree.

FIG. 26 depicts a cross-section view of the internal tree cap 1000 in a tree spool 1120 with the upper housing 1020 in an upper or running position. As shown in FIG. 26, with the lock device 1080 in its upper position, the inner split latch ring 1090 is able to move to its outer position, which allows the upper housing 1020 to be in its upper position, causing the outer split latch ring 1060 to be in its inner position, which allows for removal of the internal tree cap 1000 from the tree spool 1120.

Figure 27:
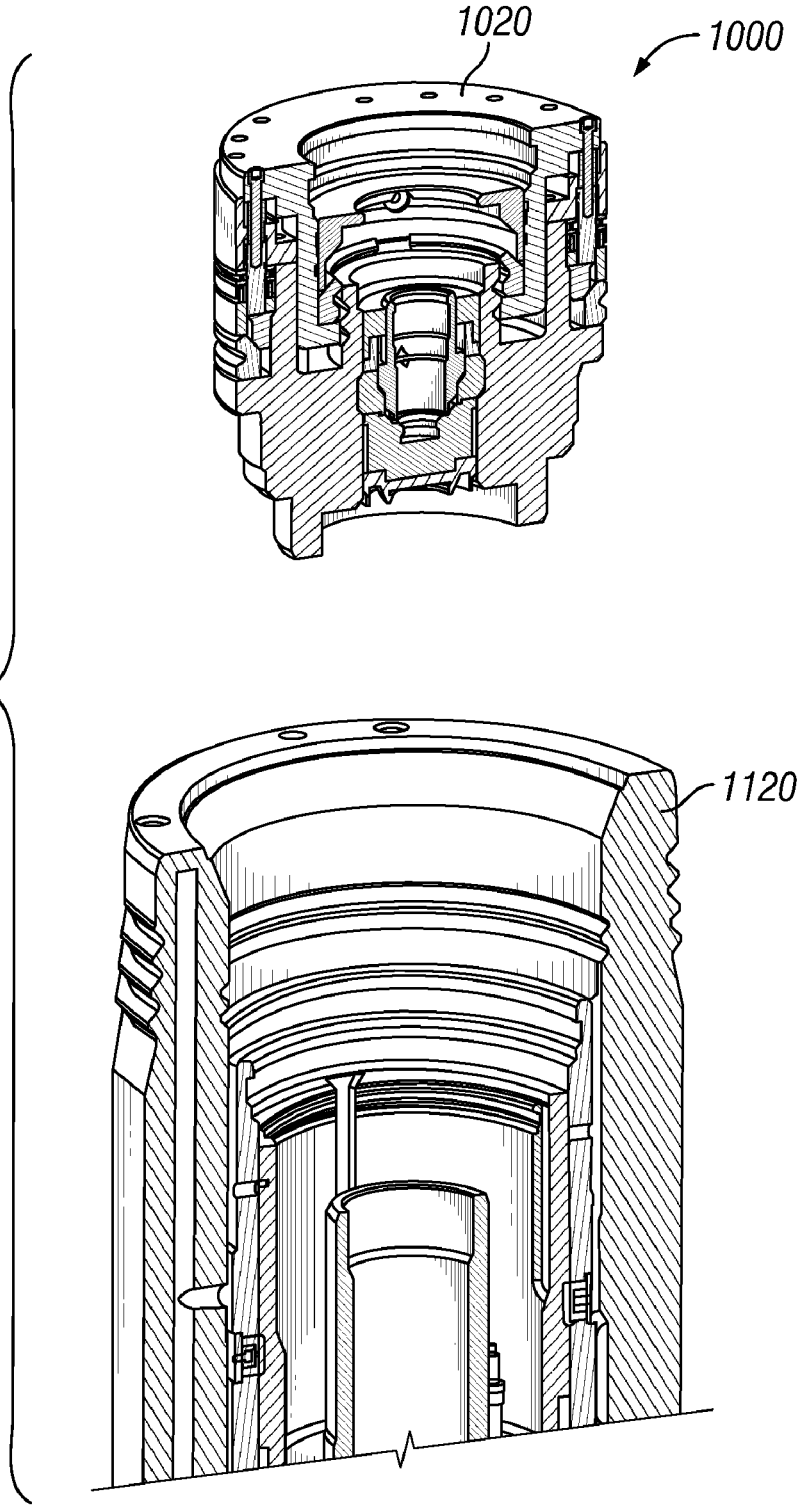
FIG. 27 shows a cross-section view of an internal tree cap that includes a wireline plug profile being retrieved from a tree.

FIG. 27 shows a cross-section view of the internal tree cap 1000 being retrieved from a tree spool 1120 with the upper housing 1020 of the tree cap 1000 in its upper or running position.

As depicted in FIGS. 23-27, the internal tree cap 1000 includes a wireline plug cavity 1010 formed as a recess within the wireline plug upper receptor 1130 and an inner lower body 1140. The wireline plug receptor 1130 includes an internal cavity 1010 into which a wireline plug may be seated.

Figure 28:
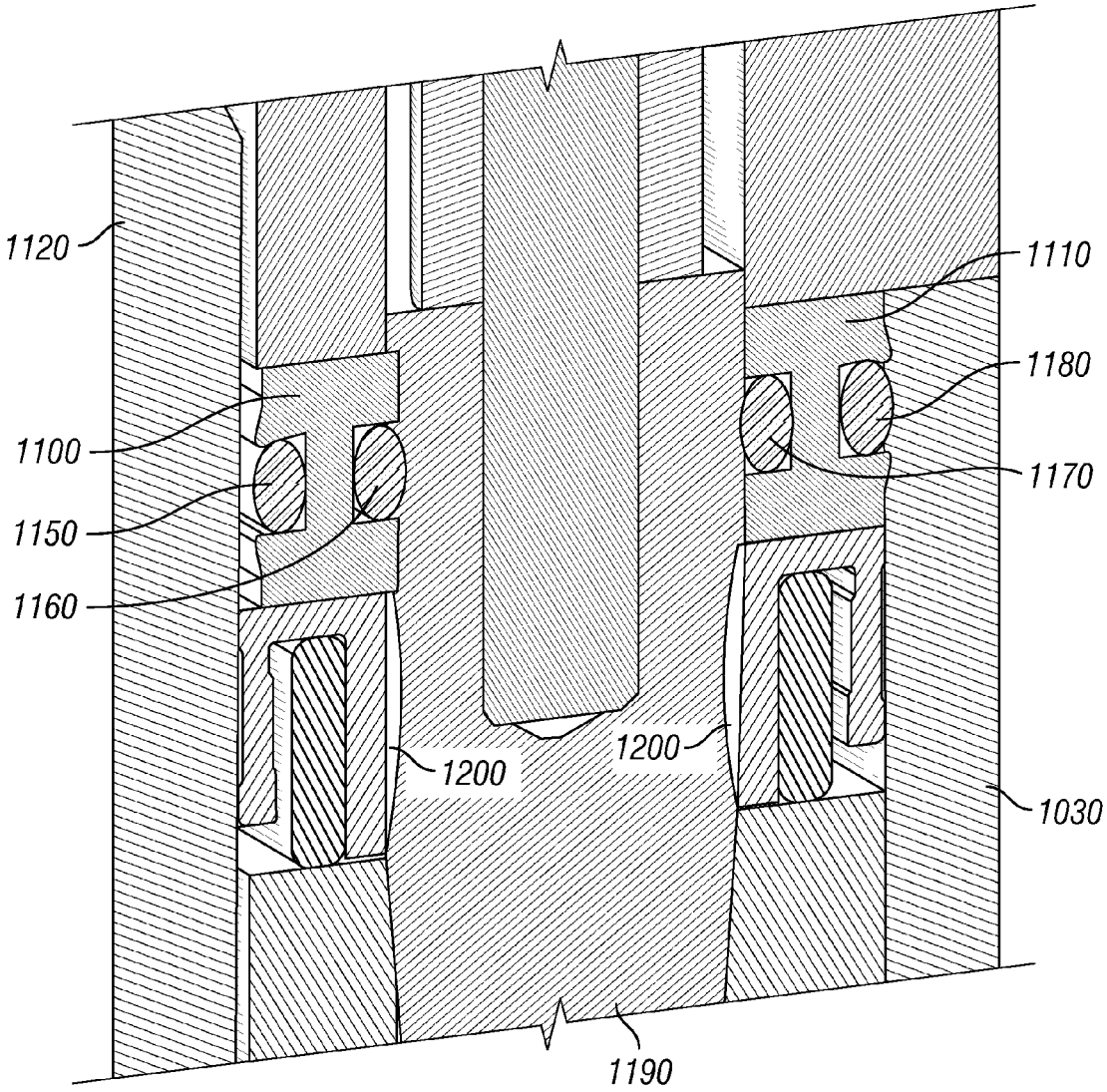
FIG. 28 shows a close-up view of one embodiment of an internal tree cap sealing assemblies.

As shown in FIG. 28, the outer sealing assembly 1100 comprises an outer seal 1150 and an inner seal 1160. When the internal tree cap 1000 is set inside a tree spool 1120, the seal 1150 contacts and seals against an inner surface of the tree spool 1120. The seal 1160 contacts a seal expansion piece 1190. The seal expansion piece 1190 has an upper position and a lower position, corresponding to the upper and lower positions of the upper housing 1020. An inner seal assembly 1110 outer seal 1170 contacts an opposite surface of the seal expansion piece 1190. An inner seal 1180 of the inner seal assembly 1110 contacts an outer surface of the lower housing 1030. As depicted in FIG. 28, the seal expansion piece has two grooves 1200, each corresponding to a seal assembly. When the upper housing 1020 is in an upper position, the seal expansion piece 1190 is also in an upper position, wherein seals 1160, 1170 are positioned within the grooves 1200. As the seal expansion piece 1190 is lowered into its lower position by downward movement of the upper housing 1020, the seals 1160, 1170 are forced out of the grooves 1200, which pushes each seal assembly 1100, 1110, away from the seal expansion piece 1190. Thus, as the upper housing 1020 is lowered into its lower position, the seal expansion piece 1190 also lowers into its lower position, causing the outer seal assembly 1100 to expanded outward, which results in a tighter seal against an inner surface of the tree spool 1120. At the same time, movement of the seal expansion piece 1190 into its lower position causes the inner seal assembly 1110 to contract inward, which results in a tighter seal against the outer surface of the lower housing 1030. As will be appreciated by those of ordinary skill in the art, other sealing means may be used that would still fall within the scope of the present disclosure.

Although various embodiments have been shown and described, the disclosure is not so limited and will be understood to include all such modifications and variations as would be apparent to one skilled in the art.

What is claimed is:

1. An internal tree cap, the tree cap comprising:

an inner housing having an upper end, a lower end, and a central opening through the inner housing, the upper end having a latching profile for engagement with a running tool;

a lower housing having an upper end and a lower end, the lower housing adapted to receive the lower end of the inner housing, wherein the inner housing is movable with respect to the lower housing between a running position and a landed position;

an inner body, the inner body located between a portion of the lower housing and the central opening of the lower end of the inner housing;

a split latch ring located between the upper end of the lower housing and a first exterior shoulder of the inner housing, the split latch ring being movable between an inner position and an outer position, wherein in the outer position the split latch ring engages a locking profile in a tree spool;

a support ring located above the split latch ring and positioned around the first exterior shoulder of the inner housing;

a bulk seal located above the support ring and being positioned around the first exterior shoulder of the inner housing;

an expansion plug located in the central opening of the inner housing, the expansion plug being movable between a lower position and an upper position;

a spring positioned between a shoulder of the expansion plug and a shoulder of the inner body, the spring being biased to move the expansion plug to the upper position;

a retainer ring connected to the inner body within the central opening of the inner housing;

at least one expansion pin, the expansion pin being movable from an inner position and an outer position through an opening in the retainer ring;

an expansion ring located between an exterior surface of the retainer ring and the central opening of the inner housing, wherein the expansion ring retains the at least one expansion pin in the inner position when the inner housing is in the running position;

wherein when the inner housing moves to the landed position the expansion ring expands into an interior recess of the inner housing, the expansion pin moves to the outer position, spring moves the expansion plug to the upper position, the first exterior shoulder moves the split latch ring to the outer position, and the support ring energizes the bulk seal against a second exterior shoulder of the inner housing and a seal profile of the tree spool.

2. The internal tree cap of claim 1 further comprising a flow passage, wherein the flow passage permits pressure equalization, flushing, or inhibitor injection.

3. The internal tree cap of claim 1, wherein in the landed position the upper end of the inner housing is flush with a top end of the tree spool.

4. The internal tree cap of claim 1, wherein the inner housing being in the landed position and split latch ring being in the outer position provide a collateral beneficial locking means to secure a tubing hanger in the tree spool.

5. The internal tree cap of claim 1 further comprising a lower adapter connected to the lower housing.

6. The internal tree cap of claim 5, wherein the lower adapter is adapted to provide a collateral beneficial locking means to secure a tubing hanger in the tree spool.

7. The internal tree cap of claim 5 further comprising at least one sealing element connected to the lower adapter, wherein the at least one sealing element is adapted to seal on an exterior surface of a tubing hanger.

8. The internal tree cap of claim 5 further comprising a stinger connected to the lower housing and at least one sealing element connected to the stinger, wherein the sealing element is adapted to provide a seal within an upper plug seal profile.

9. The internal tree cap of claim 8, wherein the at least one sealing element provides a bi-direction seal within the upper plug seal profile.

* * * * *